US007726389B2

(12) United States Patent
Watanabe

(10) Patent No.: US 7,726,389 B2
(45) Date of Patent: Jun. 1, 2010

(54) EVAPORATOR

(75) Inventor: Sumitaka Watanabe, Oyama (JP)

(73) Assignee: Showa Denko K.K., Tokyo (JP)

( * ) Notice: Subject to any disclaimer, the term of this patent is extended or adjusted under 35 U.S.C. 154(b) by 301 days.

(21) Appl. No.: 11/722,962

(22) PCT Filed: Dec. 27, 2005

(86) PCT No.: PCT/JP2005/024224

§ 371 (c)(1),
(2), (4) Date: Jun. 27, 2007

(87) PCT Pub. No.: WO2006/070918

PCT Pub. Date: Jul. 6, 2006

(65) Prior Publication Data

US 2008/0202153 A1 Aug. 28, 2008

Related U.S. Application Data

(60) Provisional application No. 60/641,740, filed on Jan. 7, 2005.

(30) Foreign Application Priority Data

Dec. 28, 2004 (JP) ..... 2004-378542

(51) Int. Cl.
*F28F 9/22* (2006.01)
*F25B 39/02* (2006.01)

(52) U.S. Cl. ..... 165/176; 62/515

(58) Field of Classification Search ..... 62/271, 62/272, 285, 290, 498, 515, 525; 165/67, 165/135, 140, 153, 183, 133
See application file for complete search history.

(56) References Cited

U.S. PATENT DOCUMENTS

| | | | | |
|---|---|---|---|---|
| 6,170,565 | B1 * | 1/2001 | Nishishita | 165/140 |
| 6,536,517 | B2 * | 3/2003 | Hoshino et al. | 165/176 |
| 2004/0069469 | A1 * | 4/2004 | Kato | 165/151 |
| 2004/0154331 | A1 * | 8/2004 | Horiuchi et al. | 62/509 |
| 2004/0159121 | A1 * | 8/2004 | Horiuchi et al. | 62/526 |

FOREIGN PATENT DOCUMENTS

| | | | |
|---|---|---|---|
| JP | 4 10530 | | 3/1992 |
| JP | 2001059690 | A * | 3/2001 |
| JP | 2001 255039 | | 9/2001 |
| JP | 2001255039 | A * | 9/2001 |
| JP | 2003 214794 | | 7/2003 |

* cited by examiner

*Primary Examiner*—Frantz F Jules
*Assistant Examiner*—Emmanuel Duke
(74) *Attorney, Agent, or Firm*—Oblon, Spivak, McClelland, Maier & Neustadt, L.L.P.

(57) ABSTRACT

An evaporator includes a plurality of heat exchange tubes extending vertically and arranged in rows spaced apart from each other in a front-rear direction. A drainage acceleration member extending vertically is disposed between the adjacent front and rear heat exchange tubes. A gap is present between each of the adjacent front and rear heat exchange tubes, and the drainage acceleration member disposed between the front and rear heat exchange tubes. The gaps serve as drain channels. The evaporator exhibits excellent drainage of condensed water.

22 Claims, 15 Drawing Sheets

EVAPORATOR

CROSS REFERENCE TO RELATED APPLICATIONS

This application is an application filed under 35 U.S.C. §111(a) claiming the benefit pursuant to 35 U.S.C. §119(e)(1) of the filing date of Provisional Application No. 60/641,740 filed Jan. 7, 2005 pursuant to 35 U.S.C. §111(b).

TECHNICAL FIELD

The present invention relates to an evaporator to be built in, for example, a car air conditioner, which is a refrigeration cycle to be mounted on an automobile.

Herein and in the appended claims, the downstream side of an air flow (a side represented by arrow X in FIGS. 1 and 10, and a right-hand side in FIG. 4) is referred to as the "front," and the opposite side as the "rear." The upper, lower, left-hand, and right-hand sides of FIG. 2 will be referred to as "upper," "lower," "left," and "right," respectively.

BACKGROUND ART

Conventionally, a so-called laminated evaporator has been widely employed as an evaporator for use in a car air conditioner. In the laminated evaporator, a plurality of flat, hollow members, each of which includes a pair of depressed plates facing each other and brazed to each other at their peripheral edge portions, are arranged in parallel, and corrugate fins are each disposed between and brazed to the adjacent flat, hollow members.

In recent years, evaporators have been required to be further reduced in size and weight and to exhibit higher performance. A known evaporator which fulfills these requirements includes a heat exchange core section configured such that heat exchange tube groups are arranged in two rows in an air flow direction, each heat exchange tube group consisting of a plurality of flat heat exchange tubes arranged at predetermined intervals; a first header which is disposed on a first-end side of the heat exchange tubes and to which the heat exchange tubes of one heat exchange tube group are connected; a second header which is disposed on the first-end side of the heat exchange tubes and rearward of the first header and to which the heat exchange tubes of the other heat exchange tube group are connected; a third header which is disposed on a second-end side of the heat exchange tubes and to which the heat exchange tubes connected to the first header are connected; and a fourth header which is disposed on the second-end side of the heat exchange tubes and to which the heat exchange tubes connected to the second header are connected. A refrigerant inlet is formed at a first end of the first header, and a refrigerant outlet is formed at an end of the second header that corresponds to the first end of the first header. A partition wall divides the interiors of the first and second headers at longitudinally intermediate portions. A refrigerant which flows into the first header from the refrigerant inlet passes through all the heat exchange tubes and all the headers and then flows out from the refrigerant outlet (refer to Japanese Patent Application Laid-Open (kokai) No. 2003-214794).

In contrast to the laminated evaporator, the evaporator described in the above-mentioned publication has implemented reduced size and weight and improved performance, so that the amount of condensed water generated on the surface of corrugate fins is increased. However, the evaporator described in the above-mentioned publication does not have a sufficient water drainage performance when the quantity of condensed water increases.

An object of the present invention is to overcome the above problem and to provide an evaporator which exhibits excellent drainage of condensed water.

DISCLOSURE OF THE INVENTION

To achieve the above object, the present invention comprises the following modes.

1) An evaporator comprising a plurality of heat exchange tubes extending vertically and arranged in rows spaced apart from each other in a front-rear direction, wherein a drainage acceleration member extending vertically is disposed between the adjacent front and rear heat exchange tubes, and a drain channel is formed between the front heat exchange tube and the drainage acceleration member and between the rear heat exchange tube and the drainage acceleration member.

2) An evaporator according to par. 1), wherein a gap is present between at least one of the two adjacent front and rear heat exchange tubes, and the drainage acceleration member disposed between the two heat exchange tubes, and the gap serves as the drain channel.

3) An evaporator according to par. 1), wherein at least one of the two adjacent front and rear heat exchange tubes, and the drainage acceleration member disposed between the two heat exchange tubes are in contact with each other; a recess is formed between the drainage acceleration member and the heat exchange tube in contact with the drainage acceleration member in such a manner as to be depressed inward with respect to a left-right direction from an extension surface of a left side surface of the heat exchange tube and to extend vertically, and a recess is formed between the drainage acceleration member and the heat exchange tube in contact with the drainage acceleration member in such a manner as to be depressed inward with respect to the left-right direction from an extension surface of a right side surface of the heat exchange tube and to extend vertically; and the recesses serve as the drain channels.

4) An evaporator according to par. 1), wherein a drain groove extending vertically is formed on at least a left or a right side surface of the drainage acceleration member.

5) An evaporator according to par. 1), wherein the heat exchange tubes are flat and are arranged such that a width direction thereof coincides with the front-rear direction, and the thickness of the drainage acceleration member as measured in the left-right direction is equal to the thickness of the heat exchange tube as measured in the left-right direction.

6) An evaporator according to par. 5), wherein a gap is present between at least one of the two adjacent front and rear heat exchange tubes, and the drainage acceleration member disposed between the two heat exchange tubes; the gap serves as the drain channel; and a relation $0<w/h\leqq 1/4$ is satisfied, where h (mm) is the thickness of the heat exchange tube and the thickness of the drainage acceleration member as measured in the left-right direction, and w (mm) is the width of the drain channel as measured in the front-rear direction.

7) An evaporator according to par. 5), wherein at least one of the two adjacent front and rear heat exchange tubes, and the drainage acceleration member disposed between the two heat exchange tubes are in contact with each other; a recess is formed between the drainage acceleration member and the heat exchange tube in contact with the drainage acceleration member in such a manner as to be depressed inward with respect to the left-right direction from an extension surface of a left side surface of the heat exchange tube and to extend vertically, and a recess is formed between the drainage acceleration member and the heat exchange tube in contact with the drainage acceleration member in such a manner as to be depressed inward with respect to the left-right direction from an extension surface of a right side surface of the heat exchange tube and to extend vertically; the recesses serve as the drain channels; and a relation $0.05 \leqq S/h \leqq 1.5$, is satisfied, where S ($mm^2$) is the cross-sectional area of the drain channel, and h (mm) is the thickness of the heat exchange tube and the thickness of the drainage acceleration member as measured in the left-right direction.

8) An evaporator according to par. 5), wherein outer surfaces of end walls of the front and rear heat exchange tubes in opposition to the drainage acceleration member, and front and rear end surfaces of the drainage acceleration member have an arcuate horizontal cross section.

9) An evaporator according to par. 5), wherein outer surfaces of end walls of the front and rear heat exchange tubes in opposition to the drainage acceleration member have an arcuate horizontal cross section, whereas front and rear end surfaces of the drainage acceleration member are flat surfaces perpendicular to left and right side surfaces of the heat exchange tubes; alternatively, the outer surfaces of end walls of the front and rear heat exchange tubes in opposition to the drainage acceleration member are flat surfaces perpendicular to the left and right side surfaces of the heat exchange tubes, whereas the front and rear end surfaces of the drainage acceleration member have an arcuate horizontal cross section.

10) An evaporator according to par. 5), wherein outer surfaces of end walls of the front and rear heat exchange tubes in opposition to the drainage acceleration member have an arcuate horizontal cross section, whereas front and rear end surfaces of the drainage acceleration member have a V-shaped horizontal cross section; alternatively, the outer surfaces of end walls of the front and rear heat exchange tubes in opposition to the drainage acceleration member have a V-shaped horizontal cross section, whereas the front and rear end surfaces of the drainage acceleration member have an arcuate horizontal cross section.

11) An evaporator according to par. 5), wherein outer surfaces of end walls of the front and rear heat exchange tubes in opposition to the drainage acceleration member, and front and rear end surfaces of the drainage acceleration member have a V-shaped horizontal cross section.

12) An evaporator according to par. 5), wherein outer surfaces of end walls of the front and rear heat exchange tubes in opposition to the drainage acceleration member have a V-shaped horizontal cross section, whereas front and rear end surfaces of the drainage acceleration member are flat surfaces perpendicular to left and right side surfaces of the heat exchange tubes; alternatively, the outer surfaces of end walls of the front and rear heat exchange tubes in opposition to the drainage acceleration member are flat surfaces perpendicular to the left and right side surfaces of the heat exchange tubes, whereas the front and rear end surfaces of the drainage acceleration member have a V-shaped horizontal cross section.

13) An evaporator according to par. 5), wherein a gap is present between at least one of the two adjacent front and rear heat exchange tubes, and the drainage acceleration member disposed between the two heat exchange tubes; the gap serves as the drain channel; a relation $0 < w/h \leqq 1/4$ is satisfied, where h (mm) is the thickness of the heat exchange tube and the thickness of the drainage acceleration member as measured in the left-right direction, and w (mm) is the width of the drain channel as measured in the front-rear direction; and an outer surface of an end wall of the heat exchange tube in opposition to the drain channel, and an outer surface of the drainage acceleration member in opposition to the drain channel are flat surfaces perpendicular to left and right side surfaces of the heat exchange tube.

14) An evaporator according to par. 5), wherein a drain groove extending vertically is formed on at least either left or right side surface of the drainage acceleration member.

15) An evaporator according to par. 1), comprising a heat exchange core section configured such that heat exchange tube groups are arranged in a plurality of rows in the front-rear direction, each heat exchange tube group consisting of a plurality of heat exchange tubes arranged at predetermined intervals in the left-right direction; a first header which is disposed on a first-end side of the heat exchange tubes and to which the heat exchange tubes of at least one heat exchange tube group are connected; a second header which is disposed on the first-end side of the heat exchange tubes and rearward of the first header and to which the heat exchange tubes of the remaining heat exchange tube groups are connected; a third header which is disposed on a second-end side of the heat exchange tubes and to which the heat exchange tubes connected to the first header are connected; and a fourth header which is disposed on the second-end side of the heat exchange tubes and to which the heat exchange tubes connected to the second header are connected, wherein a drainage acceleration member extending vertically is disposed between the adjacent front and rear heat exchange tubes.

16) A refrigeration cycle comprising a compressor, a condenser, and an evaporator, and using a chlorofluorocarbon-based refrigerant, the evaporator being an evaporator according to any one of pars. 1) to 15).

In the evaporator of any one of pars. 1) to 3), a plurality of heat exchange tubes are arranged in rows spaced apart from each other in the front-rear direction and at predetermined intervals in the left-right direction, and fins are each disposed between and joined to the heat exchange tubes adjacent to each other in the left-right direction. With this evaporator, condensed water generated on the surface of the fins is attracted, by the capillary effect, toward connection portions between the heat exchange tubes and the fins; and the condensed water attracted to the connection portions between the rear heat exchange tubes and the fins is caused to flow frontward by the effect of air flowing through air-passing clearances each being formed between the heat exchange tubes adjacent to each other in the left-right direction and is attracted, by the capillary effect, toward the drainage acceleration members, thereby entering the drain channels each being formed between the heat exchange tube and the drainage acceleration member. In the case where a gap between the adjacent front and rear heat exchange tubes is rendered identical with that of the evaporator described in the above-described publication, the cross-sectional area of a drain channel formed between the front heat exchange tube and the drainage acceleration member and between the rear heat exchange tube and the drainage acceleration member becomes relatively small. Thus, by virtue of the capillary effect, the condensed water is drained downward through the drain channels without stagnation in the drain channels. Accordingly, the evaporator exhibits enhanced drainage performance. Further, enhanced drainage of condensed water enables suppression of freezing of condensed water in the drain channels, thereby preventing a drop in cooling performance of the evaporator.

With the evaporator of par. 4), the condensed water which is caused to flow to the drainage acceleration member by the effect of air flow and the capillary effect is drained downward along the drain groove of the drainage acceleration member. Thus, drainage performance is enhanced.

With the evaporator of par. 6), the condensed water which enters the drain channel in the form of the gap between the heat exchange tube and the drainage acceleration member is efficiently drained downward through the drain channel. Thus, performance on drainage of condensed water is enhanced.

With the evaporator of par. 7), the condensed water which enters the drain channel in the form of the recess formed between the heat exchange tube and the drainage acceleration member is efficiently drained downward through the drain channel.

With the evaporator of par. 13), the condensed water which enters the drain channel in the form of the gap between the heat exchange tube and the drainage acceleration member is efficiently drained downward through the drain channel. Thus, performance on drainage of condensed water is enhanced.

With the evaporator of par. 14), the condensed water which is caused to flow to the drainage acceleration member by the effect of air flow and the capillary effect is drained downward along the drain groove of the drainage acceleration member. Thus, drainage performance is enhanced.

BEST MODE FOR CARRYING OUT THE INVENTION

Embodiments of the present invention will next be described in detail with reference to the drawings.

In the following description, the term "aluminum" encompasses aluminum alloys in addition to pure aluminum.

Embodiment 1

The present embodiment is illustrated in FIGS. 1 to 10.

Figure 1:
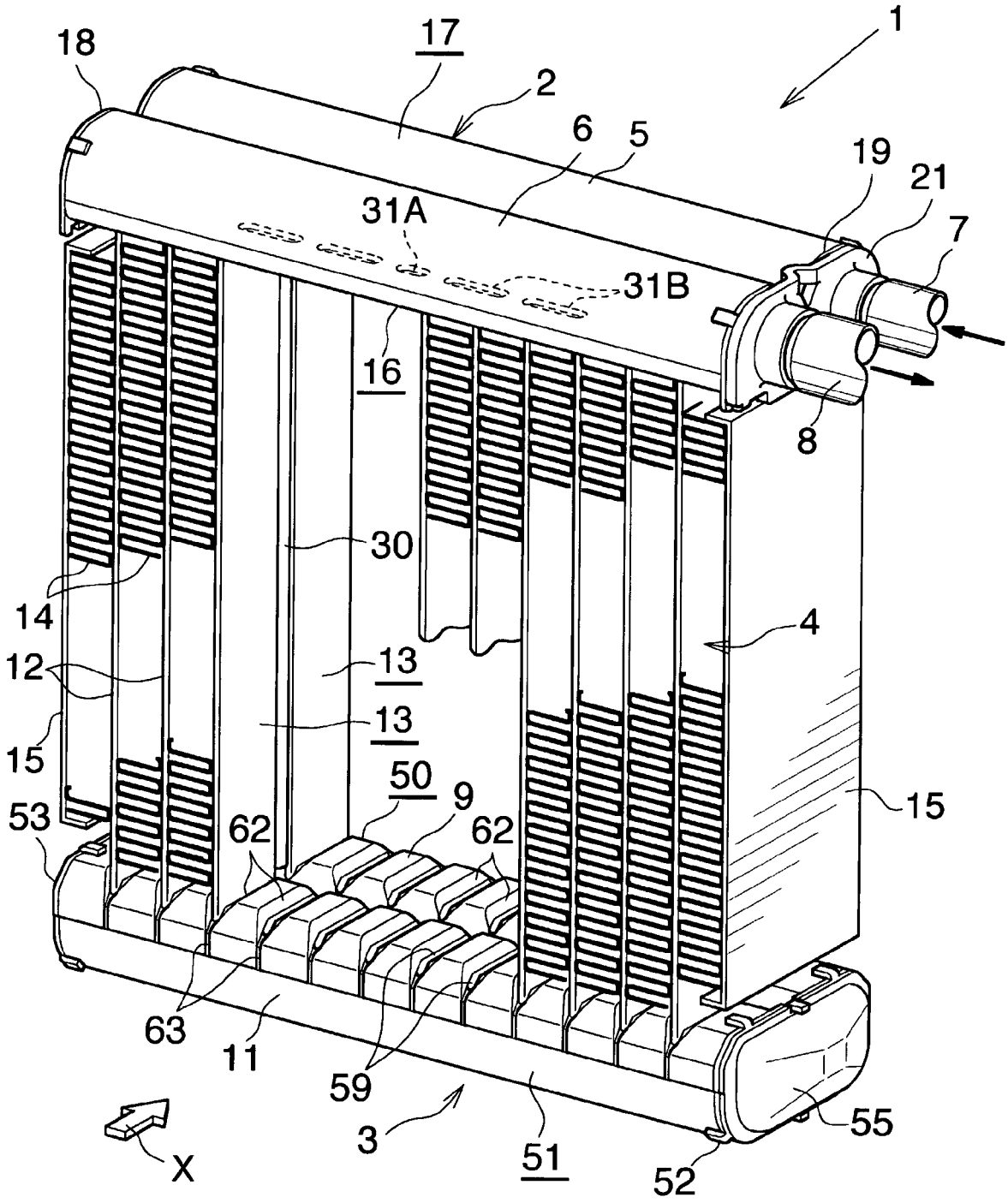
FIG. 1 is a partially cut-away perspective view showing the overall configuration of an evaporator according to Embodiment 1 of the present invention.
Figure 2:
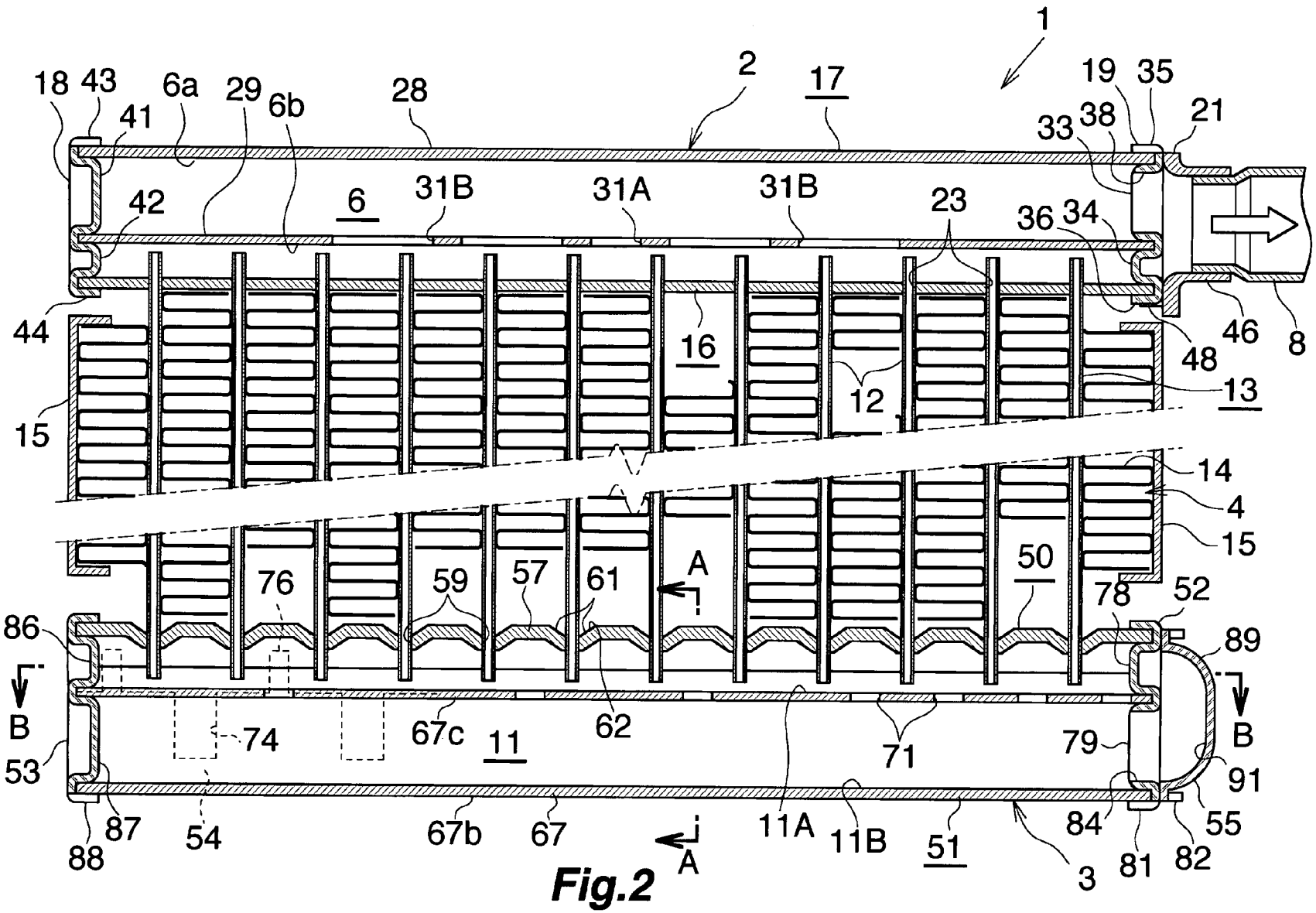
FIG. 2 is a fragmentary view in vertical section showing the evaporator shown in FIG. 1 as it is seen from the rear, with its intermediate portion omitted.

FIGS. 1 and 2 show the overall configuration of an evaporator, and FIGS. 3 to 9 show the configuration of essential portions of the evaporator. FIG. 10 shows how a refrigerant flows in the evaporator.

In FIGS. 1 and 2, the evaporator (1), which is used in a car air conditioner using a chlorofluorocarbon-based refrigerant, includes a refrigerant inlet/outlet tank (2) made of aluminum and a refrigerant turn tank (3) made of aluminum, the tanks (2) and (3) being vertically spaced apart from each other, and further includes a heat exchange core section (4) provided between the tanks (2) and (3).

The refrigerant inlet/outlet tank (2) includes a refrigerant inlet header (5) (first header) located on a side toward the front (downstream side with respect to the air flow direction) and a refrigerant outlet header (6) (second header) located on a side toward the rear (upstream side with respect to the air flow direction). The headers (5) and (6) are integrated with each other via connection means, which will be described later. A refrigerant inlet pipe (7) made of aluminum is connected to the refrigerant inlet header (5) of the refrigerant inlet/outlet tank (2). A refrigerant outlet pipe (8) made of aluminum is connected to the refrigerant outlet header (6).

The refrigerant turn tank (3) includes a refrigerant inflow header (9) (third header) located on the side toward the front and a refrigerant outflow header (11) (fourth header) located on the side toward the rear. A connection section (10) connects the headers (9) and (11) together for integration. The headers (9) and (11) and the connection section (10) define a drain gutter (20) (see FIG. 4).

The heat exchange core section (4) is configured such that heat exchange tube groups (13) are arranged in a plurality of; herein, two, rows in the front-rear direction, each heat exchange tube group (13) consisting of a plurality of heat exchange tubes (12) arranged in parallel at predetermined intervals in the left-right direction and such that corrugate fins (14) are disposed within corresponding air-passing clearances between the adjacent heat exchange tubes (12) of the heat exchange tube groups (13) and on the outer sides of the leftmost and rightmost heat exchange tubes (12) of the heat exchange tube groups (13), and are brazed to the corresponding heat exchange tubes (12). Drainage acceleration members (30) made of aluminum and extending vertically are each disposed between the adjacent front and rear heat exchange tubes (12) and are brazed to the associated corrugate fins (14). Side plates (15) made of aluminum are disposed on the outer sides of the leftmost and rightmost corrugate fins (14), and are brazed to the corresponding corrugate fins (14). The upper and lower ends of the heat exchange tubes (12) of the front heat exchange tube group (13) are connected to the refrigerant inlet header (5) and the refrigerant inflow header (9), respectively, whereby the heat exchange tubes (12) form a forward refrigerant flow section. The upper and lower ends of the heat exchange tubes (12) of the rear heat exchange tube group (13) are connected to the refrigerant outlet header (6) and the refrigerant outflow header (11), respectively, whereby the heat exchange tubes (12) form a return refrigerant flow section.

Figure 3:
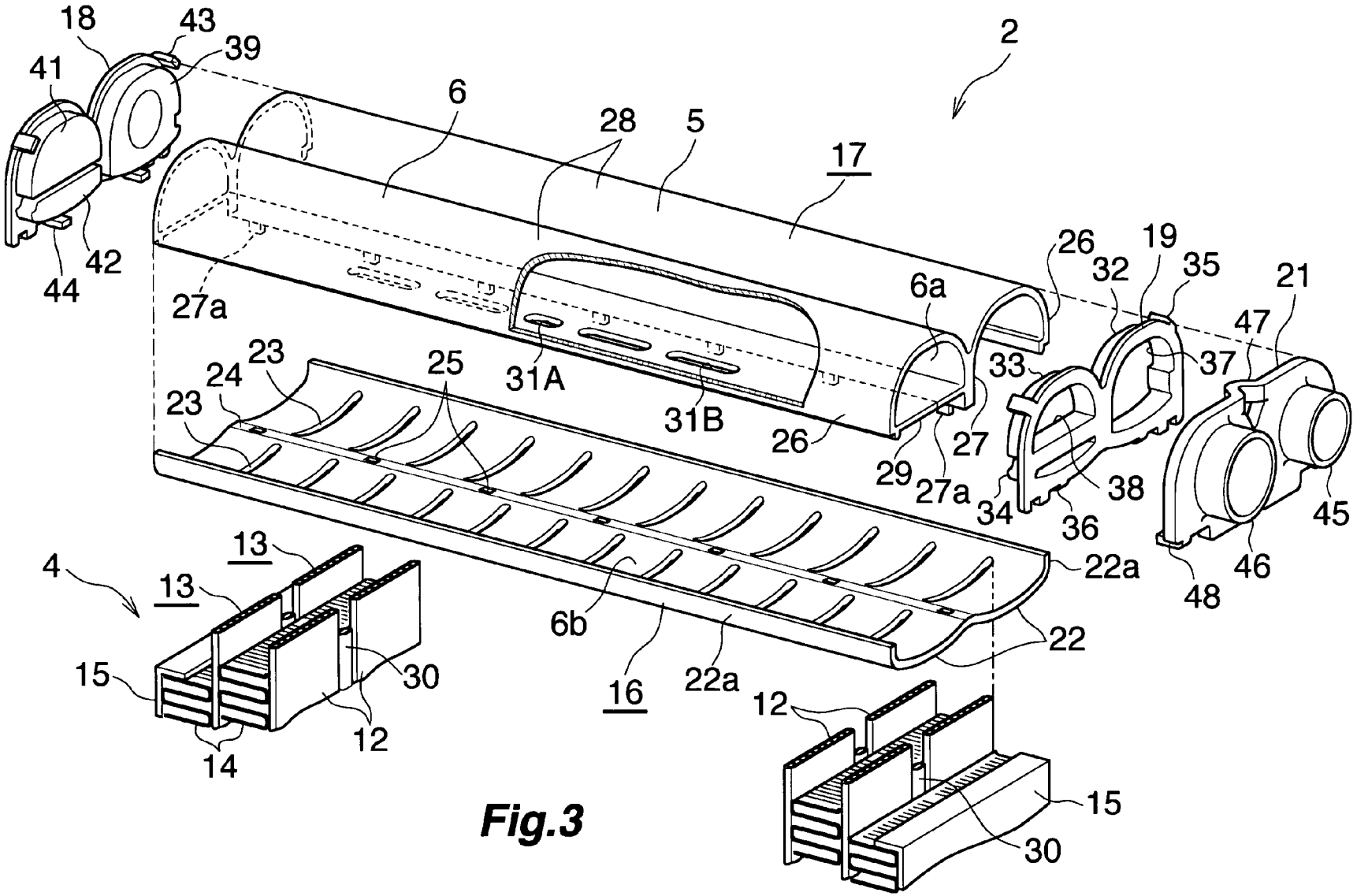
FIG. 3 is an exploded perspective view of a refrigerant inlet/outlet tank of the evaporator shown in FIG. 1.

As shown in FIG. 3, the refrigerant inlet/outlet tank (2) is formed from an aluminum brazing sheet having a brazing material layer on each of opposite sides thereof, and includes a first member (16) having a plate-like shape and to which all the heat exchange tubes (12) are connected; a second member (17) formed from a bare aluminum extrudate and covering the upper side of the first member (16); and caps (18) and (19) formed from an aluminum brazing sheet having a brazing material layer on each of opposite sides thereof, and joined to the opposite ends of the first and second members (16) and (17) to thereby close the left and right end openings. A joint plate (21) made of aluminum and elongated in the front-rear direction is brazed to the outer surface of the right-hand cap (19) while facing the respective ends of the refrigerant inlet header (5) and the refrigerant outlet header (6). The refrigerant inlet pipe (7) and the refrigerant outlet pipe (8) are connected to the joint plate (21).

The first member (16) has front and rear curved portions (22), whose central regions each have an arcuate cross section projecting downward and having a small curvature. A plurality of tube insertion holes (23), which are elongated in the front-rear direction, are formed in the curved portions (22) at predetermined intervals in the left-right direction. The tube insertion holes (23) of the front curved portion (22) and those of the rear curved portion (22) are identical in position in the left-right direction. A rising wall (22*a*) is formed integrally with each of the front edge of the front curved portion (22) and the rear edge of the rear curved portion (22), over the entire length of the front and rear edges. A flat portion (24), which serves as means for connecting together the refrigerant inlet header (5) and the refrigerant outlet header (6), is formed between the curved portions (22) of the first member (16). A plurality of through holes (25) are formed in the flat portion (24) at predetermined intervals in the left-right direction.

The second member (17) has a cross section resembling the letter m, which opens downward, and includes front and rear walls (26) extending in the left-right direction; a partition wall (27) (partition means) provided at a central region thereof between the front and rear walls (26), extending in the left-right direction, and dividing the interior of the refrigerant inlet/outlet tank (2) into a front space and a rear space; and two substantially arcuate connection walls (28) projecting upward and integrally connecting the upper end of the partition wall (27) and the upper ends of the front and rear walls (26). The partition wall (27) serves as means for connecting together the refrigerant inlet header (5) and the refrigerant outlet header (6). A flow-dividing resistance plate (29), which serves as partition means for dividing the interior of the refrigerant outlet header (6) into an upper space (6*a*) and an lower space (6*b*), integrally connects a lower end portion of the rear wall (26) of the second member (17) and a lower end portion of the partition wall (27) over the entire length thereof. A plurality of refrigerant passage holes (31A) and (31B) in a through-hole form and elongated in the left-right direction are formed in a rear region, excluding left and right end portions thereof, of the flow-dividing resistance plate (29) at predetermined intervals in the left-right direction. The lower end of the partition wall (27) projects downward beyond the lower ends of the front and rear walls (26). A plurality of projections (27*a*) are integrally formed on the lower end face of the partition wall (27) at predetermined intervals in the left-right direction in such a manner as to project downward, and are fitted into corresponding through holes (25) of the first member (16). The projections (27*a*) are formed by cutting off predetermined portions of the partition wall (27).

A leftward projecting portion (32) to be fitted into the refrigerant inlet header (5) is formed integrally with the right-hand cap (19), on the side toward the front. An upper, leftward projecting portion (33) and a lower, leftward projecting portion (34) are formed integrally with the right-hand cap (19), on the side toward the rear, and spaced apart from each other in the vertical direction. The upper, leftward projecting portion (33) is fitted into the space (6*a*) of the refrigerant outlet header (6), the space being located above the flow-dividing resistance plate (29). The lower, leftward projecting portion (34) is fitted into the space (6*b*) of the refrigerant outlet header (6), the space being located under the flow-dividing resistance plate (29). An engagement finger (35) projecting leftward is formed integrally with each of an arcuate portion extending between the front side edge and the top edge of the right-hand cap (19) and an arcuate portion extending between the rear side edge and the top edge of the right-hand cap (19). Further, an engagement finger (36) projecting leftward is formed integrally with each of a front portion and a rear portion of the lower end face of the right-hand cap (19). A refrigerant inlet (37) is formed in the bottom wall of the leftward projecting portion (32), located on the side toward the front, of the right-hand cap (19). A refrigerant outlet (38) is formed in the bottom wall of the upper, leftward projecting portion (33), located on the side toward the rear, of the right-hand cap (19). The left-hand cap (18) is a mirror image of the right-hand cap (19) and includes the following integrally formed portions: a rightward projecting portion (39) to be fitted into the refrigerant inlet header (5); an upper, rightward projecting portion (41) to be fitted into the space (6*a*) of the refrigerant outlet header (6), the space being located above the flow-dividing resistance plate (29); a lower, rightward projecting portion (42) to be fitted into the space (6*b*) of the refrigerant outlet header (6), the space being located under the flow-dividing resistance plate (29); and upper and lower engagement fingers (43) and (44) projecting rightward. No opening is formed in the bottom walls of the rightward projecting portion (39) and the upper, rightward projecting portion (41). The upper edge of the cap (18) and the upper edge of the cap (19) each assume a shape such that two substantially arcuate portions are integrally connected together at a central position in the front-rear direction, so as to coincide with the corresponding left and right ends of the upper surface of the second member (17) of the refrigerant inlet/outlet tank (2). The lower edge of the cap (18) and the lower edge of the cap (19) each assume a shape such that two substantially arcuate portions of small curvature are integrally connected together via a flat portion located centrally in the front-rear direction.

The front curved portion (22) and the flat portion (24) of the first member (16), the front wall (26), the partition wall (27), and the front connection wall (28) of the second member (17), and front portions of the left-hand and right-hand caps (18) and (19) form the refrigerant inlet header (5). The rear curved portion (22) and the flat portion (24) of the first member (16), the rear wall (26), the partition wall (27), and the rear connection wall (28) of the second member (17), and rear portions of the left-hand and right-hand caps (18) and (19) form the refrigerant outlet header (6). The refrigerant inlet header (5) and the refrigerant outlet header (6) are united together via the flat portion (24) and the partition wall (27).

The joint plate (21) includes a short, cylindrical refrigerant inflow port (45) communicating with the refrigerant inlet (37) of the right-hand cap (19), and a short, cylindrical refrigerant outflow port (46) communicating with the refrigerant outlet (38) of the right-hand cap (19). A bent portion (47) projecting leftward is formed at a portion of each of the upper and lower edge portions of the joint plate (21) located between the refrigerant inflow port (45) and the refrigerant outflow port (46). The upper bent portion (47) is fitted between two substantially arcuate portions of the upper edge of the right-hand cap (19) and is fitted between the two connection walls (28) of the second member (17). The lower bent portion (47) is fitted to the above-mentioned flat portion formed between two substantially arcuate portions of the lower edge of the right-hand cap (19) and to the flat portion (24) of the first member (16). An engagement finger (48) projecting leftward is formed integrally with each of front and rear end portions of the lower edge of the joint plate (21). The engagement fingers (48) are fitted to the lower edge of the right-hand cap (19). A diameter-reduced portion formed at one end portion of the refrigerant inlet pipe (7) is inserted into and brazed to the refrigerant inflow port (45) of the joint plate (21). Similarly, a diameter-reduced portion formed at one end portion of the refrigerant outlet pipe (8) is inserted into and brazed to the refrigerant outflow port (46) of the joint plate (21). Although unillustrated, an expansion valve attachment member is joined to the other end portions of the refrigerant inlet and outlet pipes (7) and (8) while facing the ends of the pipes (7) and (8).

The first and second members (16) and (17) of the refrigerant inlet/outlet tank (2), the caps (18) and (19), and the joint plate (21) are brazed together as follows. In assembly of the first and second members (16) and (17), the projections (27*a*) of the second member (17) are inserted into the corresponding through holes (25) of the first member (16), followed by crimping. As a result, upper end portions of the front and rear rising walls (22*a*) of the first member (16) are fitted to corresponding lower end portions of the front and rear walls (26) of the second member (17). In the thus-established condition, the first and second members (16) and (17) are brazed together by utilization of the brazing material layers of the first member (16). In attachment of the caps (18) and (19), the front projecting portions (39) and (32) are fitted into the space defined by the first and second members (16) and (17) and located frontward of the partition wall (27); the rear, upper projecting portions (41) and (33) are fitted into the space defined by the first and second members (16) and (17) and located rearward of the partition wall (27) and above the flow-dividing resistance plate (29); the rear, lower projecting portions (42) and (34) are fitted into the space defined by the first and second members (16) and (17) and located rearward of the partition wall (27) and under the flow-dividing resistance plate (29); the upper engagement fingers (43) and (35) are fitted to the connection walls (28) of the second member (17); and the lower engagement fingers (44) and (36) are fitted to the curved portions (22) of the first member (16). In the thus-established condition, the caps (18) and (19) are brazed to the first and second members (16) and (17) by utilization of the brazing material layers thereof. In attachment of the joint plate (21), the bent portions (47) are fitted to the right-hand cap (19) and the second member (17), and the engagement fingers (48) are fitted to the right-hand cap (19). In the thus-established condition, the joint plate (21) is brazed to the right-hand cap (19) by utilization of the brazing material layers of the right-hand cap (19).

The refrigerant inlet/outlet tank (2) is thus formed. The flow-dividing resistance plate (29) divides the interior of the refrigerant outlet header (6) into the upper and lower spaces (6*a*) and (6*b*). The spaces (6*a*) and (6*b*) communicate with each other through the refrigerant passage holes (31A) and (31B). The refrigerant outlet (38) of the right-hand cap (19) communicates with the upper space (6*a*) of the refrigerant outlet header (6).

Figure 4:
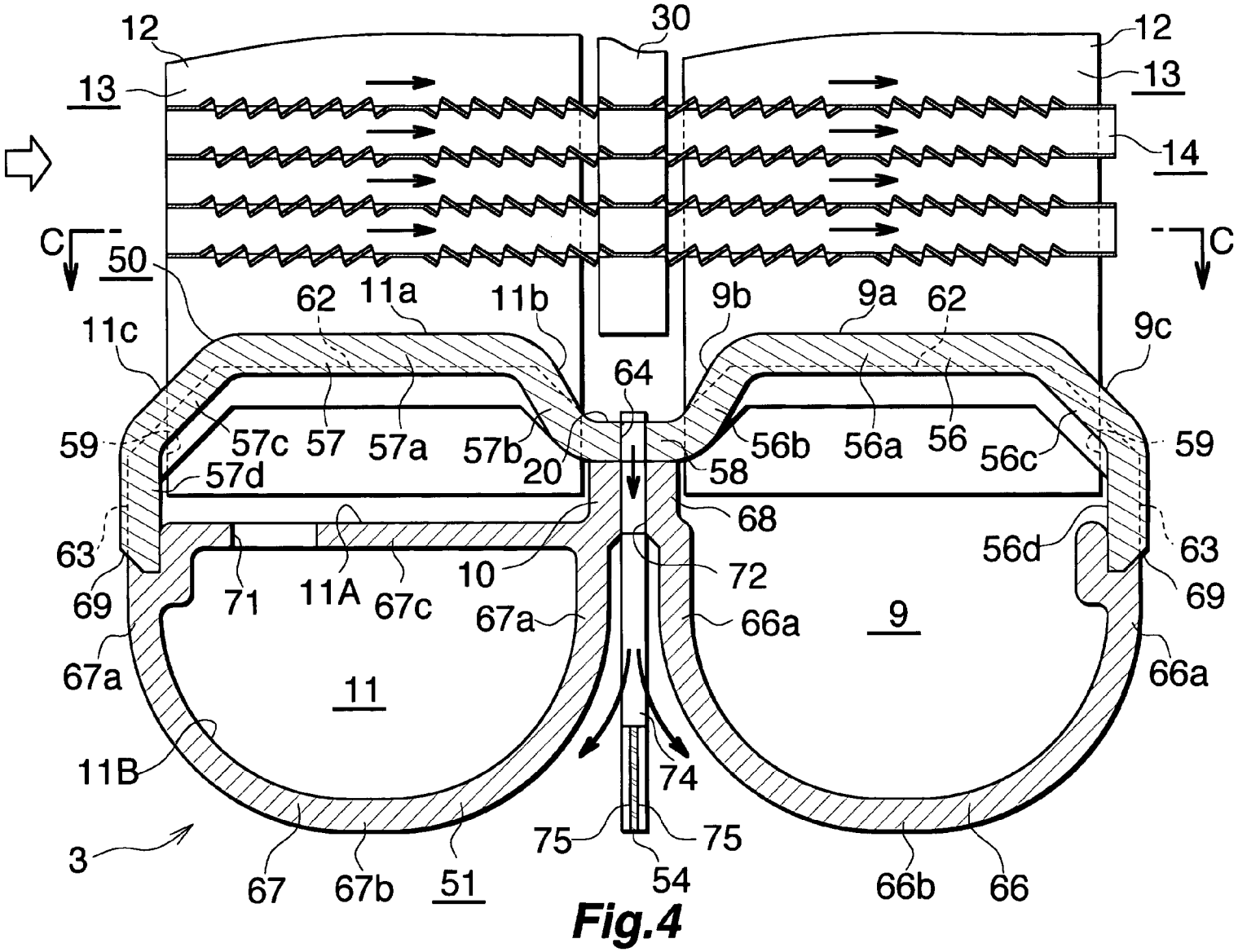
FIG. 4 is an enlarged fragmentary view in section taken along line A-A of FIG. 2.
Figure 5:
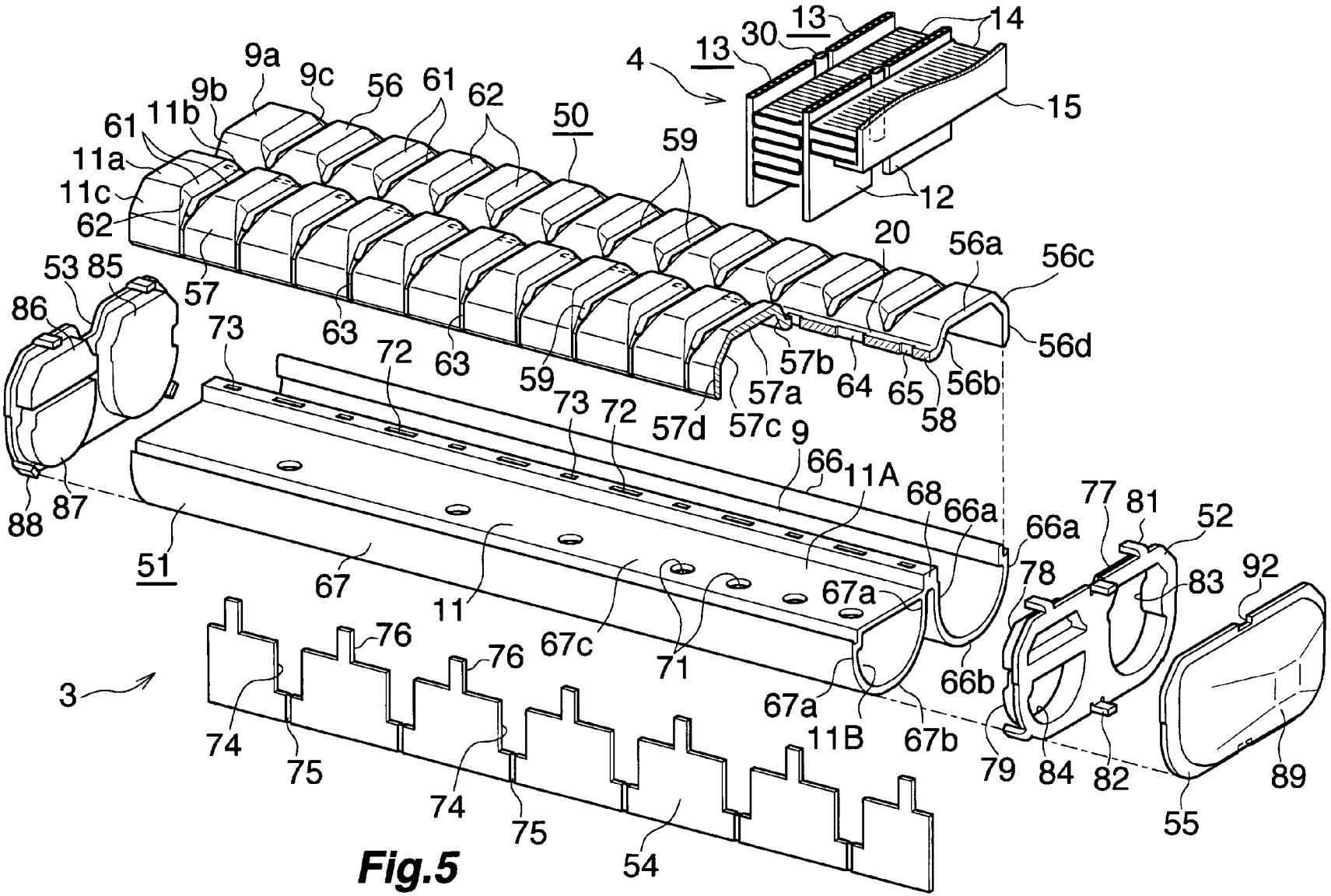
FIG. 5 is an exploded perspective view of a refrigerant turn tank of the evaporator shown in FIG. 1.
Figure 6:
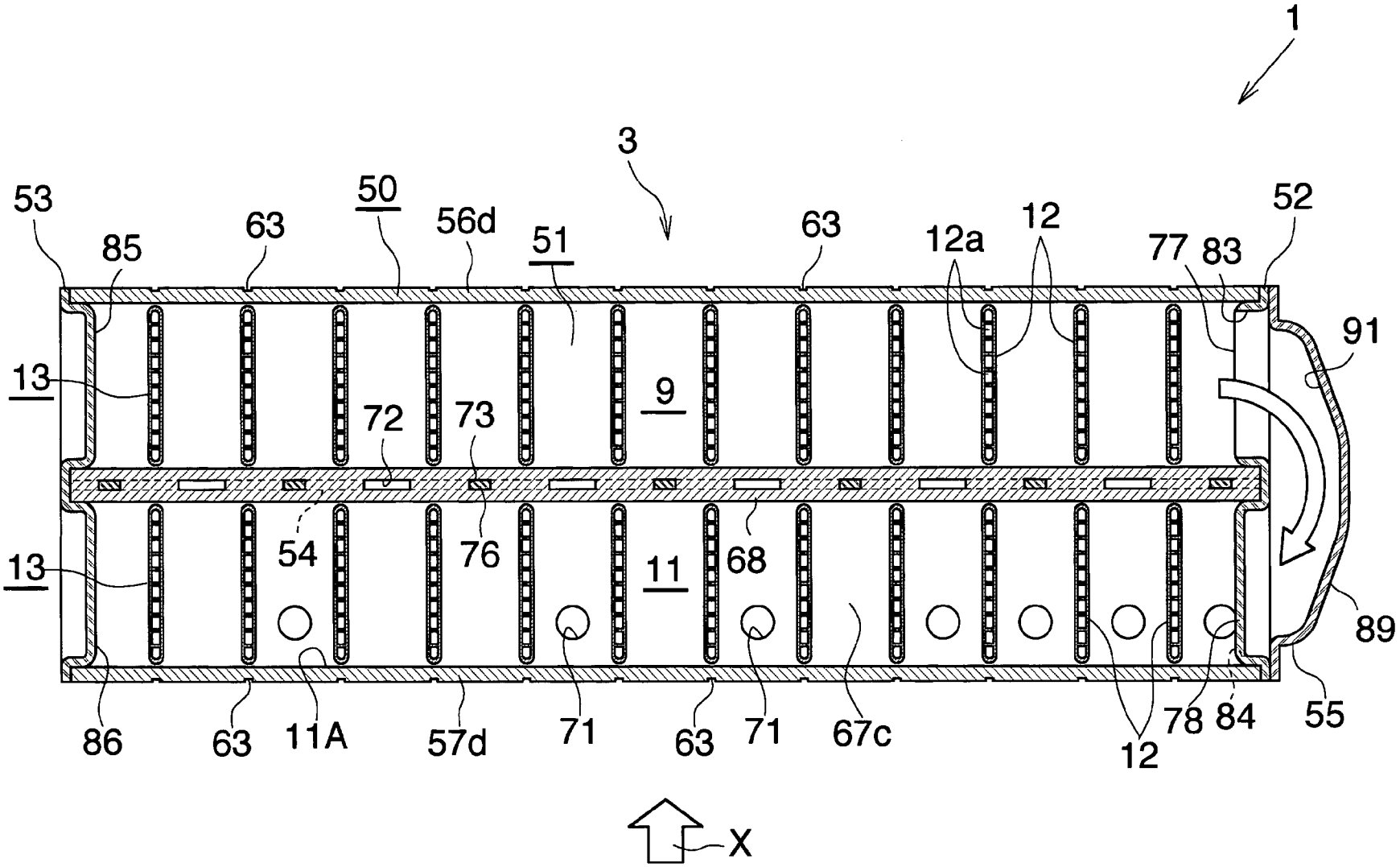
FIG. 6 is an enlarged view in section taken along line B-B of FIG. 2.
Figure 7:
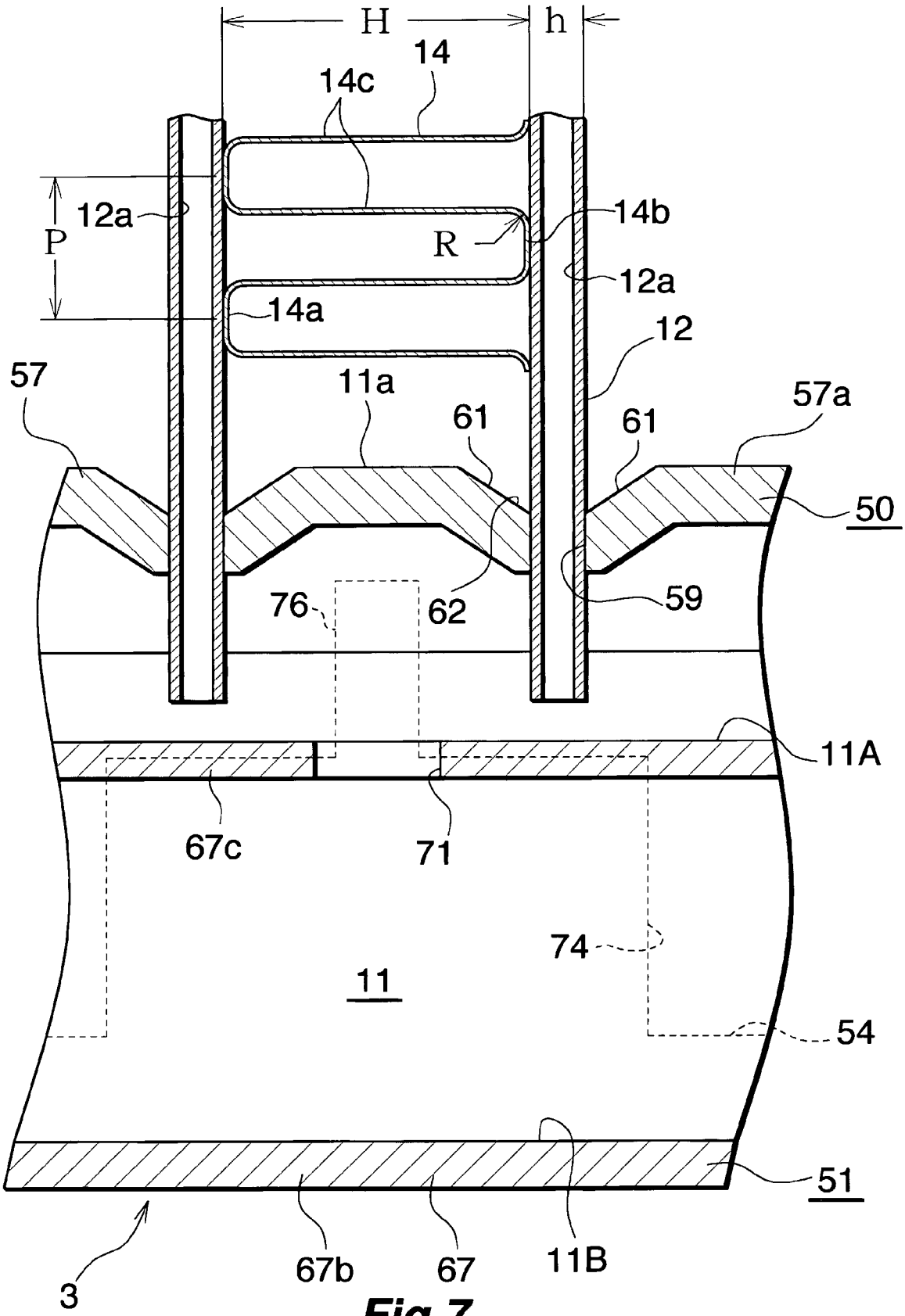
FIG. 7 is a partial enlarged view of FIG. 2.

As shown in FIGS. 4 to 6, the refrigerant turn tank (3) is formed from an aluminum brazing sheet having a brazing material layer on each of opposite sides thereof and includes a first member (50) having a plate-like shape and to which all the heat exchange tubes (12) are connected; a second member (51) formed from a bare aluminum extrudate and covering the lower side of the first member (50); caps (52) and (53) formed from an aluminum brazing sheet having a brazing material layer on each of opposite sides thereof, and closing the left and right end openings of the first and second members (50) and (51); an auxiliary drain plate (54) formed from an aluminum bare material, elongated in the left-right direction, and joined to the connection section (10); and a communication member (55) formed from an aluminum bare material, elongated in the front-rear direction, and brazed to the outer surface of the right-hand cap (52) in such a manner as to face the ends of the refrigerant inflow header (9) and the refrigerant outflow header (11). The refrigerant inflow header (9) and the refrigerant outflow header (11) communicate with each other at their right end portions via the communication member (55).

Each of the refrigerant inflow header (9) and the refrigerant outflow header (11) has a top face, a front side face, a rear side face, and a bottom face. The top faces, excluding their inside and outside portions with respect to the front-rear direction, of the headers (9) and (11) serve as horizontal flat faces (9*a*) and (11*a*), respectively. The inside portions with respect to the front-rear direction of the top faces of the headers (9) and (11) serve as first low portions (9*b*) and (11*b*), respectively, which are of faces inclined linearly downward and toward the inside with respect to the front-rear direction. The first low portions (9*b*) and (11*b*) serve as front and rear side surfaces of the drain gutter (20). The front and rear side surfaces of the drain gutter (20) fan out upward and in the front-rear direction. Preferably, the first low portions (9*b*) and (11*b*) are inclined downward at an angle of 45 degrees or greater with respect to a horizontal plane. The front and rear side surfaces of the drain gutter (20); i.e., the first low portions (9*b*) and (11*b*) of the headers (9) and (11), are not necessarily inclined linearly, but may be curved, so long as they fan out upward and in the front-rear direction. Outside portions with respect to the front-rear direction of the top faces of the headers (9) and (11) serve as second low portions (9*c*) and (11*c*), respectively, which are of faces inclined linearly downward and toward the outside with respect to the front-rear direction. Preferably, the second low portions (9*c*) and (11*c*) are inclined downward at an angle of 45 degrees or greater with respect to a horizontal plane. The front and rear outside surfaces of the headers (9) and (11) are connected to the corresponding second low portions (9*c*) and (11*c*) of the top faces.

The first member (50) includes a first header formation portion (56), which forms an upper portion of the refrigerant inflow header (9); a second header formation portion (57), which forms an upper portion of the refrigerant outflow header (11); and a connection wall (58), which connects the header formation portions (56) and (57) and forms the connection section (10). The first header formation portion (56) includes a horizontal flat top wall (56*a*); a first inclined wall (56*b*), which is formed integrally with the rear edge of the top wall (56*a*) over the entire length thereof and inclined rearward and downward; a second inclined wall (56*c*), which is formed integrally with the front edge of the top wall (56*a*) over the entire length thereof and inclined frontward and downward; and a vertical wall (56*d*), which is formed integrally with the front edge of the second inclined wall (56*c*) over the entire length thereof. The second header formation portion (57) includes a horizontal flat top wall (57*a*); a first inclined wall (57*b*), which is formed integrally with the front edge of the top wall (57*a*) over the entire length thereof and inclined frontward and downward; a second inclined wall (57*c*), which is formed integrally with the rear edge of the top wall (57*a*) over the entire length thereof and inclined rearward and downward; and a vertical wall (57*d*), which is formed integrally with the rear edge of the second inclined wall (57*c*) over the entire length thereof. The connection wall (58) integrally connects the lower edge of the first inclined wall (56*b*) of the first header formation portion (56) and the lower edge of the first inclined wall (57*b*) of the second header formation portion (57). The bottom end faces of the vertical walls (56*d*) and (57*d*) of the header formation portions (56) and (57), respectively, are inclined downward, and inward with respect to the front-rear direction. An outside portion of each of the bottom faces partially forms a stepped portion (69), which will be described later. The upper surface of the top wall (56*a*) of the first header formation portion (56) serves as the top face of the refrigerant inflow header (9); i.e., as the horizontal flat face (9*a*); the outer surfaces of the inclined walls (56*b*) and (56*c*) serve as the low portions (9*b*) and (9*c*); and the outer surface of the vertical wall (56*c*) serves as an upper portion of the front surface of the refrigerant inflow header (9). The upper surface of the top wall (57*a*) of the second header formation portion (57) serves as the top face of the refrigerant outflow header (11); i.e., as the horizontal flat face (11*a*); the upper surfaces of the inclined walls (57*b*) and (57*c*) serve as the low portions (11*b*) and (11*c*); and the outer surface of the vertical wall (57*d*) serves as an upper portion of the rear surface of the refrigerant outflow header (11).

A plurality of tube insertion holes (59) elongated in the front-rear direction are formed in the header formation portions (56) and (57) of the first member (50) at predetermined intervals in the left-right direction. The tube insertion holes (59) of the header formation portion (56) and those of the header formation portion (57) are identical in position in the left-right direction. End portions, located on a side toward the connection section (10), of the tube insertion holes (59); i.e., rear end portions of the tube insertion holes (59) of the first header formation portion (56) and front end portions of the tube insertion holes (59) of the second header formation portion (57), are located in the first inclined walls (56*b*) and (57*b*), respectively. Thus, the end portions, located on the side toward the connection section (10), of the tube insertion holes (59) are located in the side surfaces of the drain gutter (20). Outer end portions, with respect to the front-rear direction, of the tube insertion holes (59); i.e., front end portions of the tube insertion holes (59) of the first header formation portion (56) and rear end portions of the tube insertion holes (59) of the second header formation portion (57), are located in the second inclined walls (56*c*) and (57*c*), respectively. Thus, the front and rear end portions of the tube insertion holes (59) are located in the second low portions (9*c*) and (11*c*) of the top faces of the headers (9) and (11).

In the top walls (56*a*) and (57*a*) and the inclined walls (56*b*), (56*c*), (57*b*), and (57*c*) of the header formation portions (56) and (57) of the first member (50), their portions located on the left and right sides of each tube insertion hole (59) serve as inclined portions (61) which are inclined downward and toward the tube insertion hole (59). The inclined portions (61) located on the left and right sides of each tube insertion hole (59) define a recess (62). Drain grooves (63) for draining condensed water downward of the refrigerant turn tank (3) are formed, in connection with the front and rear end portions of the corresponding tube insertion holes (59), on the outer surfaces of the second inclined walls (56*c*) and (57*c*) and the vertical walls (56*d*) and (57*d*) of the header formation portions (56) and (57) of the first member (50). The bottom of each drain groove (63) extends downward as the distance from the corresponding tube insertion hole (59) increases. The bottom of a portion of each drain groove (63) located on the second inclined wall (56*c*) or (57*c*); i.e., on the second low portion (9*c*) or (11*c*), is linearly inclined, with respect to a horizontal plane, downward and toward the front or the rear. Preferably, the bottom of the portion of each drain groove (63) located on the second low portion (9*c*) or (11*c*) is inclined at an angle of 45 degrees or greater with respect to the horizontal plane. The lower end of a portion of each drain groove (63) located on the vertical wall (56*d*) or (57*d*) opens at the bottom end face of the vertical wall (56*d*) or (57*d*).

A plurality of drain through-holes (64) elongated in the left-right direction are formed in the connection wall (58) of the first member (50) at predetermined intervals in the left-right direction. Also, a plurality of fixation though-holes (65) are formed in the connection wall (58) of the first member (50) at predetermined intervals in the left-right direction while being shifted from the drain through-holes (64).

The second member (51) includes a first header formation portion (66), which forms a lower portion of the refrigerant inflow header (9); a second header formation portion (67), which forms a lower portion of the refrigerant outflow header (11); and a connection wall (68), which connects together the header formation portions (66) and (67) and is brazed to the connection wall (58) of the first member (50) to thereby form the connection section (10). The first header formation portion (66) includes vertical front and rear walls (66*a*), and a bottom wall (66*b*) integrally connecting the bottom ends of the front and rear walls (66*a*), projecting downward, and having a substantially arcuate cross section. The second header formation portion (67) includes vertical front and rear walls (67*a*); a bottom wall (67*b*) integrally connecting the bottom ends of the front and rear walls (67*a*), projecting downward, and having a substantially arcuate cross section; and a horizontal flow-dividing control wall (67*c*) integrally connecting upper end portions of the front and rear walls (67*a*). The connection wall (68) integrally connects an upper end portion of the rear wall (66*a*) of the first header formation portion (66) and an upper end portion of the front wall (67*a*) of the second header formation portion (67). The outer surface of the front wall (66*a*) of the first header formation portion (66) and the outer surface of the rear wall (67*a*) of the second header formation portion (67) are located inward, with respect to the front-rear direction, of the outer surface of the vertical wall (56*d*) of the first header formation portion (56) and the outer surface of the vertical wall (57*d*) of the second header formation portion (57), respectively, of the first member (50). Thus, the stepped portion (69) is provided at each of joint portions between the vertical walls (56*d*) and (57*d*) of the first member (50) and the front and rear walls (66*a*) and (67*a*) of the second member (51); the outer surfaces of the vertical walls (56*d*) and (57*d*) are located outward, with respect to the front-rear direction, of the outer surfaces of the front and rear walls (66*a*) and (67*a*), respectively, via the corresponding stepped portions (69); and the entire bottom end of each drain groove (63) opens at the corresponding stepped portion (69) (see FIG. 4). The outer surface of an upper edge portion of the front wall (66*a*) of the first header formation portion (66) is flush with the bottom surface of a portion of the drain groove (63) located on the vertical wall (56*d*), and the outer surface of an upper edge portion of the rear wall (67*a*) of the second header formation portion (67) is flush with the bottom surface of a portion of the drain groove (63) located on the vertical wall (57*d*). The outer surface of the front wall (66*a*) of the first header formation portion (66) serves as a lower portion of the front surface of the refrigerant inflow header (9). The outer surface of the rear wall (67*a*) of the second header formation portion (67) serves as a lower portion of the rear surface of the refrigerant outflow header (11).

A plurality of circular refrigerant passage holes (71) in a through-hole form are formed in a rear region of the flow-dividing control wall (67*c*) of the second header formation portion (67) of the second member (51) at predetermined intervals in the left-right direction. The distance between the two adjacent circular refrigerant passage holes (71) increases gradually as the distance from the left end of the flow-dividing control wall (67*c*) increases. Notably, the distance between the two adjacent circular refrigerant passage holes (71) may be constant. A plurality of drain through holes (72) elongated in the left-right direction are formed in the connection wall (68) of the second member (51), in alignment with the corresponding drain through-holes (64) of the first member (50). Also, a plurality of fixation through-holes (73) are formed in the connection wall (68), in alignment with the corresponding fixation through-holes (65) of the first member (50).

Cutouts (74) are formed in the auxiliary drain plate (54) in such a manner as to extend from its upper edge and to correspond to the drain through-holes (64) and (72) of the first and second members (50) and (51). The width of an open portion of the cutout (74) as measured in the left-right direction is equal to the length of the drain through-holes (64) and (72) as measured in the left-right direction. Auxiliary drain grooves (75) are formed on the front and rear surfaces of the auxiliary drain plate (54) as follows: the auxiliary drain grooves (75) extend vertically and are connected to the corresponding lower end portions of the cutouts (74); and their lower end portions are open at the bottom face of the auxiliary drain plate (54). Projections (76) are formed at the top edge of the auxiliary drain plate (54) in such a manner as to align with the corresponding fixation through-holes (65) and (73) of the first and second members (50) and (51) and to project upward so as to be inserted into the corresponding fixation through-holes (65) and (73).

The caps (52) and (53) assume a plate-like form, and are formed, by press work, from an aluminum brazing sheet having a brazing material layer on each of opposite sides thereof. A leftward projecting portion (77) to be fitted into the refrigerant inflow header (9) is formed integrally with the right-hand cap (52), on the side toward the front. An upper, leftward projecting portion (78) and a lower, leftward projecting portion (79) are formed integrally with the right-hand cap (52), on the side toward the rear, and spaced apart from each other in the vertical direction. The upper, leftward projecting portion (78) is fitted into a space (11A) of the refrigerant outflow header (11), the space being located above the flow-dividing control wall (67*c*). The lower, leftward projecting portion (79) is fitted into a space (11B) of the refrigerant outflow header (11), the space being located under the flow-dividing control wall (67*c*). In the right-hand cap (52), an engagement finger (81) projecting leftward is formed integrally with each of an arcuate portion extending between the front side edge and the bottom edge and an arcuate portion extending between the rear side edge and the bottom edge, and is also formed integrally with the top edge at front and rear positions; and further, an engagement finger (82) projecting rightward is formed on each of the upper and lower edges at a central position with respect to the front-rear direction. Through holes (83) and (84) are formed in the bottom wall of the front, leftward projecting portion (77) and the bottom wall of the rear, lower, leftward projecting portion (79), respectively, of the right-hand cap (52). The front through hole (83) establishes communication between the interior and the exterior of the refrigerant inflow header (9). The rear through hole (84) establishes communication between the interior and the exterior of the space (11B), located under the flow-dividing control wall (67*c*), of the refrigerant outflow header (11).

A rightward projecting portion (85) to be fitted into the refrigerant inflow header (9) is formed integrally with the left-hand cap (53), on the side toward the front. An upper, rightward projecting portion (86) and a lower, rightward projecting portion (87) are formed integrally with the left-hand cap (53), on the side toward the rear, and spaced apart from each other in the vertical direction. The upper, rightward projecting portion (86) is fitted into the space (11A) of the refrigerant outflow header (11), the space being located above the flow-dividing control wall (67*c*). The lower, rightward projecting portion (87) is fitted into the space (11B) of the refrigerant outflow header (11), the space being located under the flow-dividing control wall (67*c*). In the left-hand cap (53), an engagement finger (88) projecting rightward is formed integrally with each of an arcuate portion extending between the front side edge and the bottom edge, and an arcuate portion extending between the rear side edge and the bottom edge, and is also formed integrally with the top edge at front and rear positions. No through hole is formed in the bottom walls of the rightward projecting portion (85) and the lower, rightward projecting portion (87).

The communication member (55) is formed, by press work, from an aluminum bear material and assumes, as viewed from the right, a plate-like form identical with that of the right-hand cap (52). A peripheral edge portion of the communication member (55) is brazed to the outer surface of the right-hand cap (52). An outward bulging portion (89) is formed on the communication member (55) so as to establish communication between the two through holes (83) and (84) of the right-hand cap (52). The interior of the outward bulging portion (89) serves as a communication channel (91) for establishing communication between the through holes (83) and (84) of the right-hand cap (52). A cutout (92) is formed on each of the upper and lower edges of the communication member (55) at a central position with respect to the front-rear direction. The engagement fingers (82) of the right-hand cap (52) are fitted into the corresponding cutouts (92).

In assembly of the refrigerant turn tank (3), the first and second members (50) and (51), the auxiliary drain plate (54), the caps (52) and (53), and the communication member (55) are brazed together as follows. In assembly of the first member (50) and the second member (51), the connection walls (58) and (68) are brought in contact with each other such that the drain through-holes (64) and (72) are aligned with each other and such that the fixation through-holes (65) and (73) are aligned with each other; the bottom ends of the vertical walls (56*d*) and (57*d*) of the header formation portions (56) and (57) are engaged with the corresponding top ends of the front wall (66*a*) of the first header formation portion (66) and the rear wall (67*a*) of the second header formation portion (67); and the projections (76) of the auxiliary drain plate (54) are inserted into the fixation through-holes (65) and (73) of the members (50) and (51) and then crimped, thereby tacking the members (56) and (57) together. In the thus-established condition, these members are brazed together by utilization of the brazing material layers of the first member (50). The auxiliary drain plate (54) is brazed to the connection walls (58) and (68) of the members (50) and (51) by utilization of the brazing material layers of the first member (50). In attachment of the caps (52) and (53), the front projecting portions (77) and (85) are fitted into the space defined by the first header formation portions (56) and (66) of the members (50) and (51); the rear, upper projecting portions (78) and (86) are fitted into the upper space defined by the second header formation portions (57) and (67) of the members (50) and (51) and located above the flow-dividing control wall (67*c*); the rear, lower projecting portions (79) and (87) are fitted into the lower space defined by the second header formation portions (57) and (67) of the members (50) and (51) and located under the flow-dividing control wall (67*c*); the upper engagement fingers (81) and (88) are fitted to the first member (50); and the lower engagement fingers (81) and (88) are fitted to the second member (51). In the thus-established condition, the caps (52) and (53) are brazed to the first and second members (50) and (51) by utilization of the brazing material layers thereof. In attachment of the communication member (55), the communication member (55) is engaged with the right-hand cap (52) such that the engagement fingers (82) of the right-hand cap (52) are fitted into the corresponding cutouts (92). In the thus-established condition, the communication member (55) is brazed to the right-hand cap (52) by utilization of the brazing material layers of the right-hand cap (52).

The refrigerant turn tank (3) is thus formed. The first header formation portions (56) and (66) of the members (50) and (51) define the refrigerant inflow header (9). The second header formation portions (57) and (67) define the refrigerant outflow header (11). The flow-dividing control wall (67*c*) divides the interior of the refrigerant outflow header (11) into the upper and lower spaces (11A) and (11B). The spaces (11A) and (11B) communicate with each other through the circular refrigerant passage holes (71). The rear through hole (84) of right-hand cap (52) communicates with the lower space (11B) of the refrigerant outflow header (11). The interior of the refrigerant inflow header (9) and the lower space (11B) of the refrigerant outflow header (11) communicate with each other via the through holes (83) and (84) of the right-hand cap (52) and the communication channel (91) in the outward bulging portion (89) of the communication member (55). The connection walls (58) and (68) of the members (50) and (51) define the connection section (10). The first low portion (9*b*) of the refrigerant inflow header (9), the first low portion (11*b*) of the refrigerant outflow header (11), and the connection section (10) define the drain gutter (20).

Each of the heat exchange tubes (12) is formed from a bare aluminum extrudate and assumes a flat form having a wide width in the front-rear direction. In the heat exchange tube (12), a plurality of refrigerant channels (12*a*) extending in the longitudinal direction thereof are formed in parallel therein. The outer surfaces of the front and rear end walls of the heat exchange tube (12) have an arcuate horizontal cross section such that a central portion thereof projects outward (see FIG. 8). In the following description, what the term "arcuate" means is not limited to a portion of a circle in the strict sense of the term, but encompasses a portion of, for example, an ellipse. The front heat exchange tubes (12) and the rear heat exchange tubes (12) are arranged in such a manner as to be identical in position in the left-right direction. Upper end portions of the heat exchange tubes (12) are inserted into the corresponding tube insertion holes (23) of the first member (16) of the refrigerant input/output tank (2) and are brazed to the first member (16) by utilization of the brazing material layers of the first member (16). Lower end portions of the heat exchange tubes (12) are inserted into the corresponding tube insertion holes (59) of the first member (50) of the refrigerant turn tank (3) and are brazed to the first member (50) by utilization of the brazing material layers of the first member (50). The front heat exchange tubes (12) communicate with the refrigerant inlet header (5) and the refrigerant inflow header (9). The rear heat exchange tubes (12) communicate with the refrigerant outlet header (6) and the refrigerant outflow header (11).

Preferably, the thickness of the heat exchange tube (12) as measured in the left-right direction; i.e., a tube height (h), is 0.75 mm to 1.5 mm (see FIG. 7); the width of the heat exchange tube (12) as measured in the front-rear direction is 12 mm to 18 mm; the wall thickness of the heat exchange tube (12) is 0.175 mm to 0.275 mm; the thickness of a partition wall separating the refrigerant channels (12*a*) from each other is 0.175 mm to 0.275 mm; the pitch of the partition walls is 0.5 mm to 3.0 mm; and the outer surfaces of the front and rear end walls each have a radius of curvature of 0.35 mm to 0.75 mm as measured on the outer surface thereof.

In place of use of the heat exchange tube (12) formed from an aluminum extrudate, a heat exchange tube to be used may be formed such that an inner fin is inserted into a seam welded pipe of aluminum so as to form a plurality of refrigerant channels therein. Alternatively, a heat exchange tube to be used may be formed as follows. An aluminum brazing sheet having a brazing material layer on each of opposite sides thereof is subjected to a rolling process so as to form a plate that includes two flat-wall-forming portions connected together via a connection portion; side-wall-forming portions, which are formed, in a bulging condition, integrally with the corresponding flat-wall-forming portions at their side edges located in opposition to the connection portion; and a plurality of partition-wall-forming portions, which are formed integrally with the flat-wall-forming portions in such a manner as to project from the flat-wall-forming portions and to be arranged at predetermined intervals in the width direction of the flat-wall-forming portions. The thus-prepared plate is bent at the connection portion into a hairpin form such that the side-wall-forming portions abut each other, followed by brazing. The partition-wall-forming portions become partition walls.

Each of the corrugated fins (14) is made in a wavy form from an aluminum brazing sheet having a brazing material layer over opposite surfaces thereof. The corrugate fin (14) includes wave crest portions (14*a*), wave trough portions (14*b*), and horizontal flat connection portions (14*c*) each connecting together the wave crest portion (14*a*) and the wave trough portion (14*b*) (see FIG. 7). A plurality of louvers are formed at the connection portions (14*c*) in such a manner as to be juxtaposed in the front-rear direction. The front and rear heat exchange tubes (12) share the corrugate fin (14). The width of the corrugate fin (14) as measured in the front-rear direction is approximately equal to the span between the front edge of the front heat exchange tube (12) and the rear edge of the rear heat exchange tube (12). The wave crest portions (14*a*) and the wave trough portions (14*b*) of the corrugate fin (14) are brazed to the front and rear heat exchange tubes (12).

The fin height (H) of the corrugate fin (14) means the direct distance between the wave crest portion (14*a*) and the wave trough portion (14*b*). Preferably, the fin height (H) is 7.0 mm to 10.0 mm. The fin pitch (Pf) of the corrugate fin (14) means ½ the distance (P) between vertically central portions of adjacent wave crest portions (14*a*); i.e., (Pf)=P/2. Preferably, the fin pitch (Pf) is 1.3 mm to 1.8 mm. Each of the wave crest portion (14*a*) and the wave trough portion (14*b*) of the corrugate fin (14) includes a flat portion, which is brazed in a surface contact condition to the flat tubes (12), and round portions, which are located at corresponding opposite ends of the flat portion and connected to the corresponding connection portions (14*c*). Preferably, the round portions have a radius (R) of curvature of 0.7 mm or less (see FIG. 7).

Figure 8:
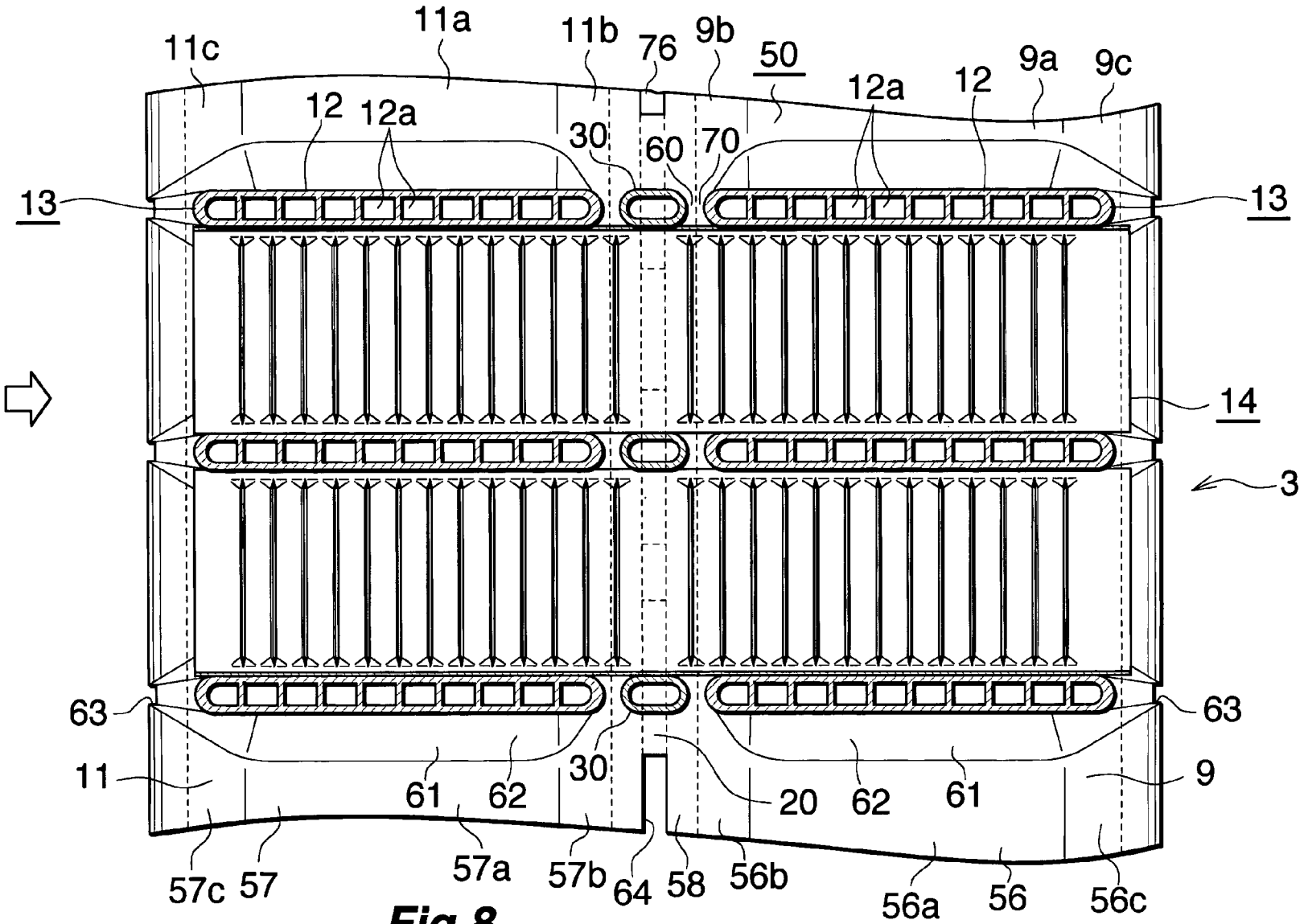
FIG. 8 is an enlarged fragmentary view in section taken along line C-C of FIG. 4.
Figure 9:
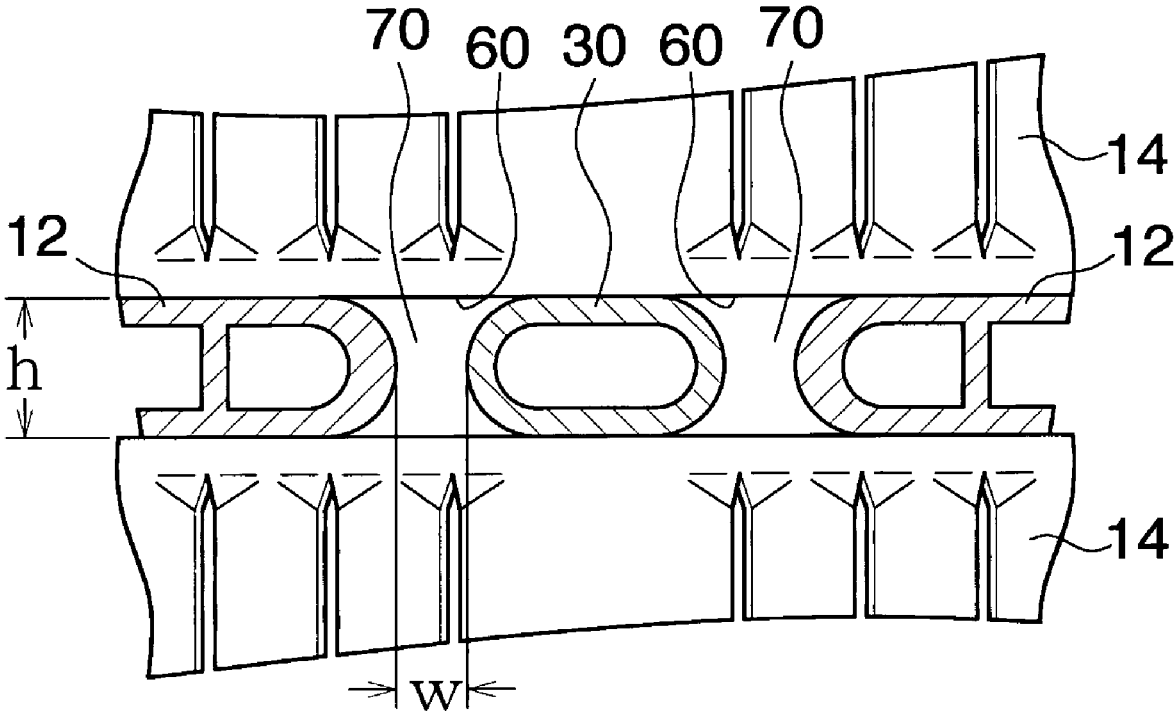
FIG. 9 is a partial enlarged view of FIG. 8.
Figure 10:
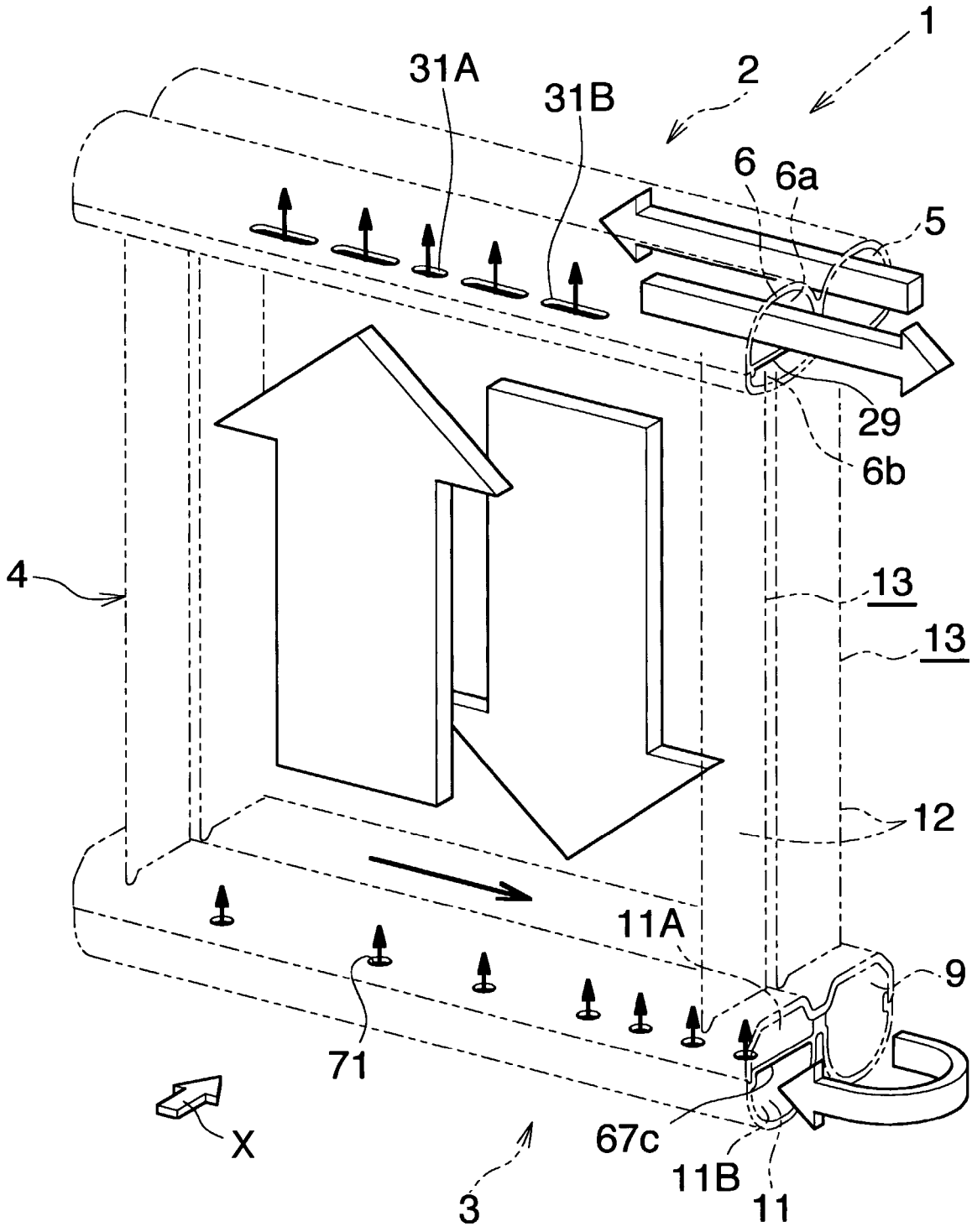
FIG. 10 is a diagram showing the flow of a refrigerant in the evaporator shown in FIG. 1.

As shown in FIGS. 8 and 9, the drainage acceleration member (30) is hollow; has a flat form such that its width along the front-rear direction is somewhat elongated; and its thickness as measured in the left-right direction is equal to the thickness, or the tube height (h), of the heat exchange tube (12) as measured in the left-right direction. The front and rear end surfaces of the drainage acceleration member (30) have an arcuate horizontal cross section such that a central portion thereof projects outward with respect to the front-rear direction. A gap (70) is present between the front end of the drainage acceleration member (30) and the front heat exchange tube (12) and between the rear end of the drainage acceleration member (30) and the rear heat exchange tube (12), thereby forming drain channels (60). Preferably, the relation $0<w/h\leqq 1/4$ is satisfied, where h (mm) is the thickness of the heat exchange tube (12) and the thickness of the drainage acceleration member (30) as measured in the left-right direction, and w (mm) is the width of the gap (70) as measured in the front-rear direction at its narrowest portion; i.e., the width of the gap (70) as measured between central portions with respect to the left-right direction. The relation $w/h>1/4$ may cause insufficiency in terms of a capillary effect of attracting condensed water toward the drain channels (60) and a capillary effect of draining condensed water downward along the drain channels (60).

In manufacture of the evaporator (1), component members thereof excluding the refrigerant inlet pipe (7) and the refrigerant outlet pipe (8) are assembled and provisionally fixed together, and then all the component members are brazed together.

The evaporator (1), together with a compressor and a condenser, constitutes a refrigeration cycle which uses a fluorocarbon refrigerant and which is installed in a vehicle, such as an automobile, as a car air conditioner.

In the evaporator (1) described above, as shown in FIG. 10, two-phase refrigerant of vapor-liquid phase having passed through a compressor, a condenser, and an expansion valve enters the refrigerant inlet header (5) of the refrigerant inlet/outlet tank (2) from the refrigerant inlet pipe (7) through the refrigerant inflow port (45) of the joint plate (21) and the refrigerant inlet (37) of the right-hand cap (19). Then, the refrigerant dividedly flows into the refrigerant channels (12*a*) of all of the front heat exchange tubes (12).

The refrigerant having entered the refrigerant channels (12*a*) of all the front heat exchange tubes (12) flows downward through the refrigerant channels (12*a*) and enters the refrigerant inflow header (9) of the refrigerant turn tank (3). The refrigerant having entered the refrigerant inflow header (9) flows rightward and then flows through the front through hole (83) of the right-hand cap (52), the communication channel (91) in the outward bulging portion (89) of the communication member (55), and the rear through hole (84) of the right-hand cap (52), thereby turning its flow direction and entering the lower space (11B) of the refrigerant outflow header (11).

Even when the distribution of temperature (dryness of refrigerant) of the refrigerant flowing through the front heat exchange tubes (12) becomes nonuniform due to a failure in the refrigerant flowing from the refrigerant inlet header (5) to the front heat exchange tubes (12) in a uniformly divided condition, the refrigerant is mixed up when the refrigerant outflowing from the refrigerant inflow header (9) turns its flow direction and flows into the lower space (11B) of the refrigerant outflow header (11), so that its temperature becomes uniform.

The refrigerant having entered the lower space (11B) of the refrigerant outflow header (11) flows leftward; enters the upper space (11A) through the circular refrigerant passage holes (71) of the flow-dividing control wall (67*c*); and dividedly flows into the refrigerant channels (12*a*) of all of the rear heat exchange tubes (12).

The refrigerant having flown into the refrigerant channels (12) of the heat exchange tubes (12) flows upward, in opposition to the previous flow direction; enters the lower space (6*b*) of the refrigerant outlet header (6); and enters the upper space (6*a*) through the elongated refrigerant passage holes (31A) and (31B) of the flow-dividing resistance plate (29). Since the flow-dividing control wall (29) imparts resistance to the flow of the refrigerant, the divided flow from the upper space (11A) of the refrigerant outflow header (11) to the rear heat exchange tubes (12) becomes uniform, and the divided flow from the refrigerant inlet header (5) to the front heat exchange tubes (12) becomes uniform to a greater extent. As a result, the refrigerant flow rate becomes uniform among all the heat exchange tubes (12), so that the temperature distribution throughout the heat exchange core section (4) becomes uniform.

Next, the refrigerant having entered the upper space (6*a*) of the refrigerant outlet header (6) flows out to the refrigerant outlet pipe (8) through the refrigerant outlet (38) of the right-hand cap (19) and the refrigerant outflow port (46) of the joint plate (21). While flowing through the refrigerant channels (12*a*) of the front heat exchange tubes (12) and through the refrigerant channels (12*a*) of the rear heat exchange tubes (12), the refrigerant is subjected to heat exchange with the air flowing through the air-passing clearances in the direction of arrow X shown in FIGS. 1 and 10 and flows out from the evaporator (1) in a vapor phase.

At this time, condensed water is generated on the heat exchange tubes (12) and the surface of the corrugate fins (14), particularly, on the surface of the corrugate fins (14). The generated condensed water mostly flows, by the capillary effect, toward joint portions between the heat exchange tubes (12) and the wave crest portions (14*a*) of the corrugate fins (14) and toward joint portions between the heat exchange tubes (12) and the wave trough portions (14*b*) of the corrugate fins (14). The condensed water attracted to the connection portions between the rear heat exchange tubes (12) and the corrugate fins (14) is caused to flow frontward by the effect of air flowing through air-passing clearances each being formed between the heat exchange tubes (12) adjacent to each other in the left-right direction and is attracted, by the capillary effect, toward the drainage acceleration members (30), thereby entering the drain channels (60). By virtue of the capillary effect, the condensed water is drained downward through the drain channels (60). Accordingly, drainage performance is enhanced. As a result, freezing of condensed water can be suppressed, thereby preventing a drop in cooling performance of the evaporator. Meanwhile, the condensed water attracted to the connection portions between the front heat exchange tubes (12) and the corrugate fins (14) is caused to flow frontward by the effect of air flowing through air-passing clearances each being formed between the heat exchange tubes (12) adjacent to each other in the left-right direction and is then drained downward along the front end surfaces of the front heat exchange tubes (12).

The condensed water having been drained downward through the drain channels (60) enters the drain gutter (20). When the condensed water collected in the drain gutter (20) reaches a certain amount, the condensed water flows down the connection section (10) through the drain through-holes (64) and (72); flows along side edge portions of the cutouts (74) of the auxiliary drain plate (54); enters the auxiliary drain grooves (75); flows down in the auxiliary drain grooves (75); and drops downward below the refrigerant turn tank (3) from the bottom end openings of the auxiliary drain grooves (75). The condensed water having been drained downward along the front end surfaces of the front heat exchange tubes (12) enters the drain grooves (63); flows in the drain grooves (63); and drops downward below the refrigerant turn tank (3) from the bottom end openings of the drain grooves (63); i.e., from the openings of the stepped portions (69). Thus is drained away the generated condensed water.

Next will be described examples of experiments which were conducted for evaluation of drainage performance of an evaporator.

Experiment Example 1

A prepared test assembly was configured such that the heat exchange tubes (12), the drainage acceleration members (30), and the corrugate fins (14) were assembled as in the case of the above-described embodiment, but the refrigerant inlet/outlet tank (2) and the refrigerant turn tank (3) were not attached thereto. The heat exchange tubes (12) and the drainage acceleration members (30) have a thickness h of 1.4 mm as measured in the left-right direction; the gap (70) between the heat exchange tubes (12) and the corresponding drainage acceleration members (30) has a width w of 0.25 mm as measured in the front-rear direction; the drainage acceleration members (30) have a width of 3.5 mm as measured in the front-rear direction; the corrugate fins (14) have a fin height (H) of 8 mm; and the fin pitch (P) is 1.5 mm. Opposite end openings of the heat exchange tubes (12) and those of the drainage acceleration members (30) were closed. The test assembly was immersed in water contained in a water tank so as to eliminate air remaining in spaces between the heat exchange tubes (12) and spaces between the corrugate fins (14) and was then allowed to stand for 30 minutes. Then, the test assembly was lifted out of the water in an upright condition. The weight of the test assembly in the upright condition was measured for 1,800 seconds for evaluation of drainage performance.

Comparative Experiment Example 1

A prepared test assembly had the same configuration as that of Experiment Example 1 except that no drainage acceleration members were arranged between the front and rear heat exchange tubes (12). The test assembly was evaluated for drainage performance in a manner similar to that of Experiment Example 1.

Figure 11:
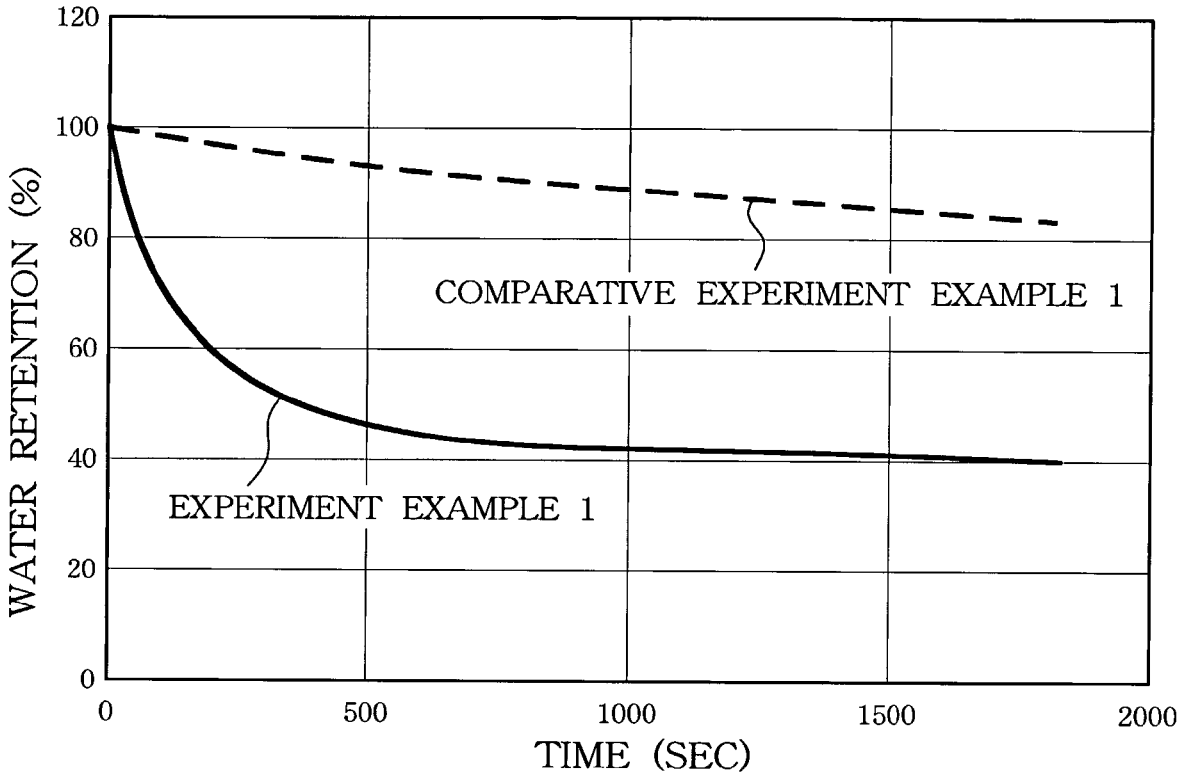
FIG. 11 is a graph showing the results of Experiment Example 1 and Comparative Experiment Example 1.

FIG. 11 shows the results of Experiment Example 1 and Comparative Experiment Example 1. In FIG. 11, water retention weight is the percentage of remaining weight to weight which was measured immediately after the evaporator was lifted out of the water in the upright condition and which was taken as 100%. A reduction in water retention weight means an increase in quantity of drained water; i.e., improvement in drainage performance.

Embodiment 2

Figure 12:
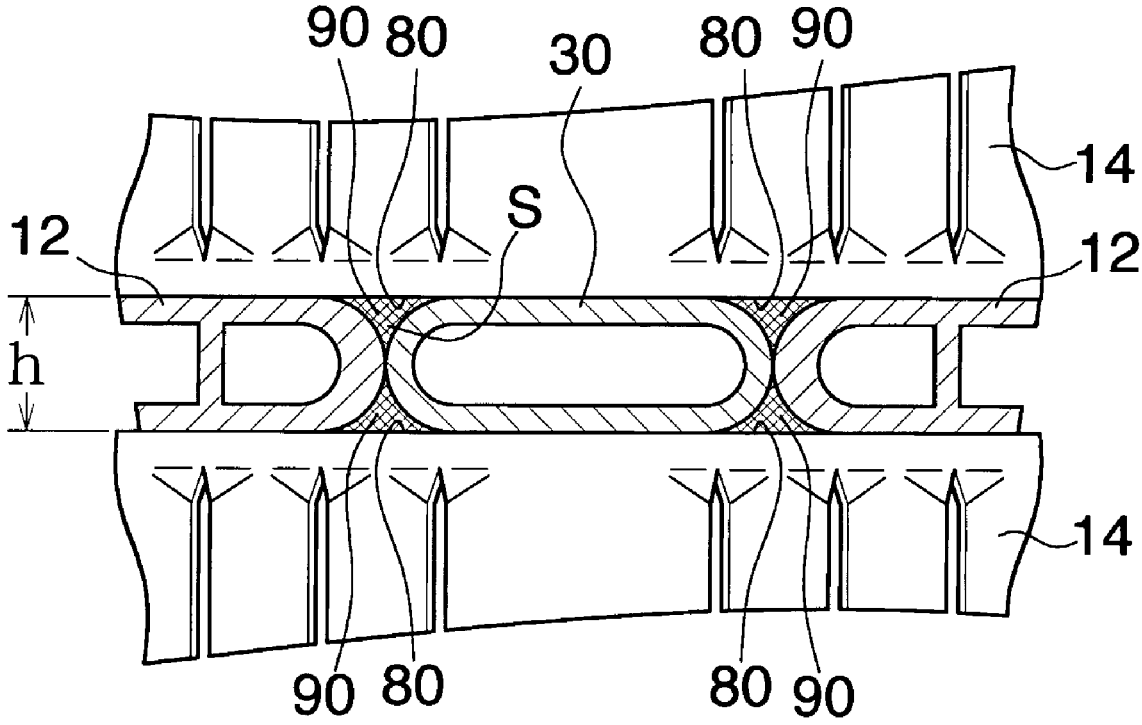
FIG. 12 is a view equivalent to FIG. 9, showing an evaporator according to Embodiment 2 of the present invention.

This embodiment is shown in FIG. 12.

In Embodiment 2, the outer surface of the inner end wall with respect to the front-rear direction of the front heat exchange tube (12) and the front end surface of the drainage acceleration member (30) are in contact with each other, and the outer surface of the inner end wall with respect to the front-rear direction of the rear heat exchange tube (12) and the rear end surface of the drainage acceleration member (30) are in contact with each other. Recesses (90) are formed between the front heat exchange tube (12) and the drainage acceleration member (30) and between the rear heat exchange tube (12) and the drainage acceleration member (30) in such a manner as to be depressed inward with respect to the left-right direction from extension surfaces of the left and right side surfaces of the heat exchange tubes (12) and to extend vertically. The recesses (90) serve as drain channels (80). Preferably, the relation $0.05 \leqq S/h \leqq 1.5$ is satisfied, where S ($mm^2$) is the cross-sectional area (crosshatched portion in FIG. 12) of the drain channel (80), and h (mm) is the thickness of the heat exchange tube (12) and the thickness of the drainage acceleration member (30) as measured in the left-right direction. An S/h value which falls outside the above range may cause insufficiency in terms of a capillary effect of attracting condensed water toward the drain channels (80) and a capillary effect of draining condensed water downward along the drain channels (80).

Other configurational features are identical with those of Embodiment 1.

The above two embodiments are described while mentioning the evaporator applied to an evaporator of a car air conditioner which uses a chlorofluorocarbon-based refrigerant. However, the present invention is not limited thereto. The evaporator of the present invention may be applied to an evaporator of a car air conditioner used in a vehicle, such as an automobile, the car air conditioner including a compressor, a gas cooler, an intermediate heat exchanger, an expansion valve, and an evaporator, and using a supercritical refrigerant such as a $CO_2$ refrigerant.

Modified embodiments of the heat exchange tube and those of the drainage acceleration member will next be described.

Figure 13:
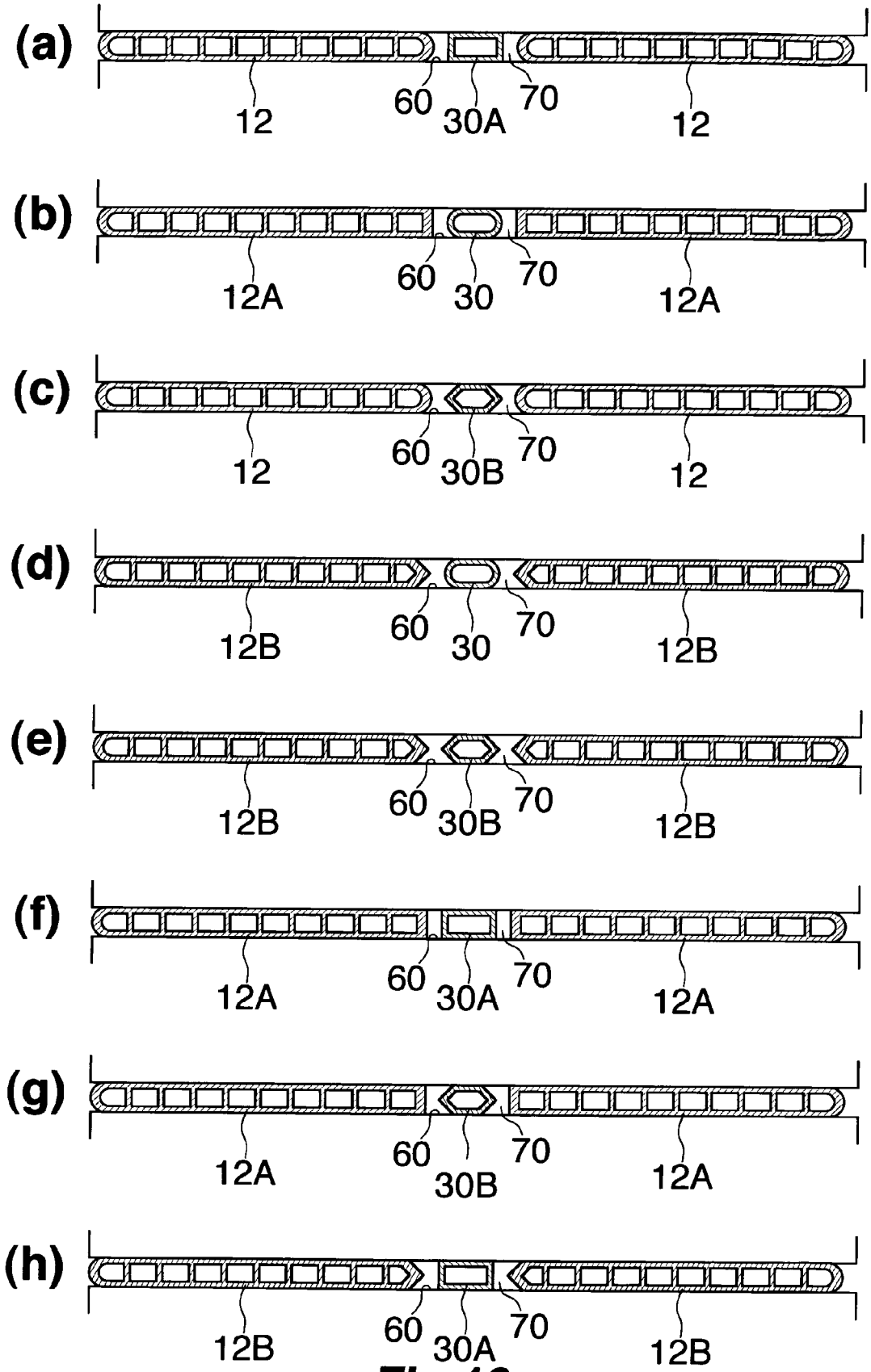
FIG. 13 is a set of horizontal sectional views showing modified embodiments of a drainage acceleration member and those of a heat exchange tube.

FIG. 13 shows modified embodiments in which the gaps (70) are present between the heat exchange tubes and the drainage acceleration member and serve as the drain channels (60) as in the case of Embodiment 1. In the description of the modified embodiments, corresponding parts of Embodiment 1 and the modified embodiments are denoted by like reference numerals, and repeated description thereof is omitted.

In the modified embodiment shown in FIG. 13(*a*), the front and rear end surfaces of a drainage acceleration member (30A) are flat surfaces perpendicular to the left and right side surfaces of the heat exchange tubes (12).

In the modified embodiment shown in FIG. 13(*b*), the outer surface of the rear end wall of a front heat exchange tube (12A) and the outer surface of the front end wall of a rear heat exchange tube (12A) are flat surfaces perpendicular to the left and right side surfaces of the heat exchange tubes (12A).

In the modified embodiment shown in FIG. 13(*c*), the front and rear end surfaces of a drainage acceleration member (30B) have a V-shaped horizontal cross section such that central portions with respect to the left-right direction project outward with respect to the front-rear direction.

In the modified embodiment shown in FIG. 13(*d*), the outer surface of the rear end wall of a front heat exchange tube (12B) has a V-shaped horizontal cross section such that a central portion with respect to the left-right direction projects rearward, and the outer surface of the front end wall of a rear heat exchange tube (12B) has a V-shaped horizontal cross section such that a central portion with respect to the left-right direction projects frontward.

In the modified embodiment shown in FIG. 13(*e*), the drainage acceleration member (30B) is the same as that shown in FIG. 13(*c*), and the front and rear heat exchange tubes (12B) are the same as those shown in FIG. 13(*d*).

In the modified embodiment shown in FIG. 13(*f*), the drainage acceleration member (30A) is the same as that shown in FIG. 13(*a*), and the front and rear heat exchange tubes (12A) are the same as those shown in FIG. 13(*b*).

In the modified embodiment shown in FIG. 13(*g*), the drainage acceleration member (30B) is the same as that shown in FIG. 13(*c*), and the front and rear heat exchange tubes (12A) are the same as those shown in FIG. 13(*b*).

In the modified embodiment shown in FIG. 13(*h*), the drainage acceleration member (30A) is the same as that shown in FIG. 13(*a*), and the front and rear heat exchange tubes (12B) are the same as those shown in FIG. 13(*d*).

In the modified embodiments shown in FIG. 13, the drainage acceleration members (30), (30A), and (30B) are made of aluminum and are hollow. The thickness along the left-right direction of the heat exchange tubes (12), (12A), and (12B) and that of the drainage acceleration members (30), (30A), and (30B) are equal to each other. Preferably, the requirement mentioned in the section of Embodiment 1; i.e., $0<w/h\leqq 1/4$, is satisfied, where h (mm) is the thickness of the heat exchange tubes (12), (12A), and (12B) and the thickness of the drainage acceleration members (30), (30A), and (30B) as measured in the left-right direction, and w (mm) is the width of the previously mentioned gap as measured in the front-rear direction at its narrowest portion.

Figure 14:
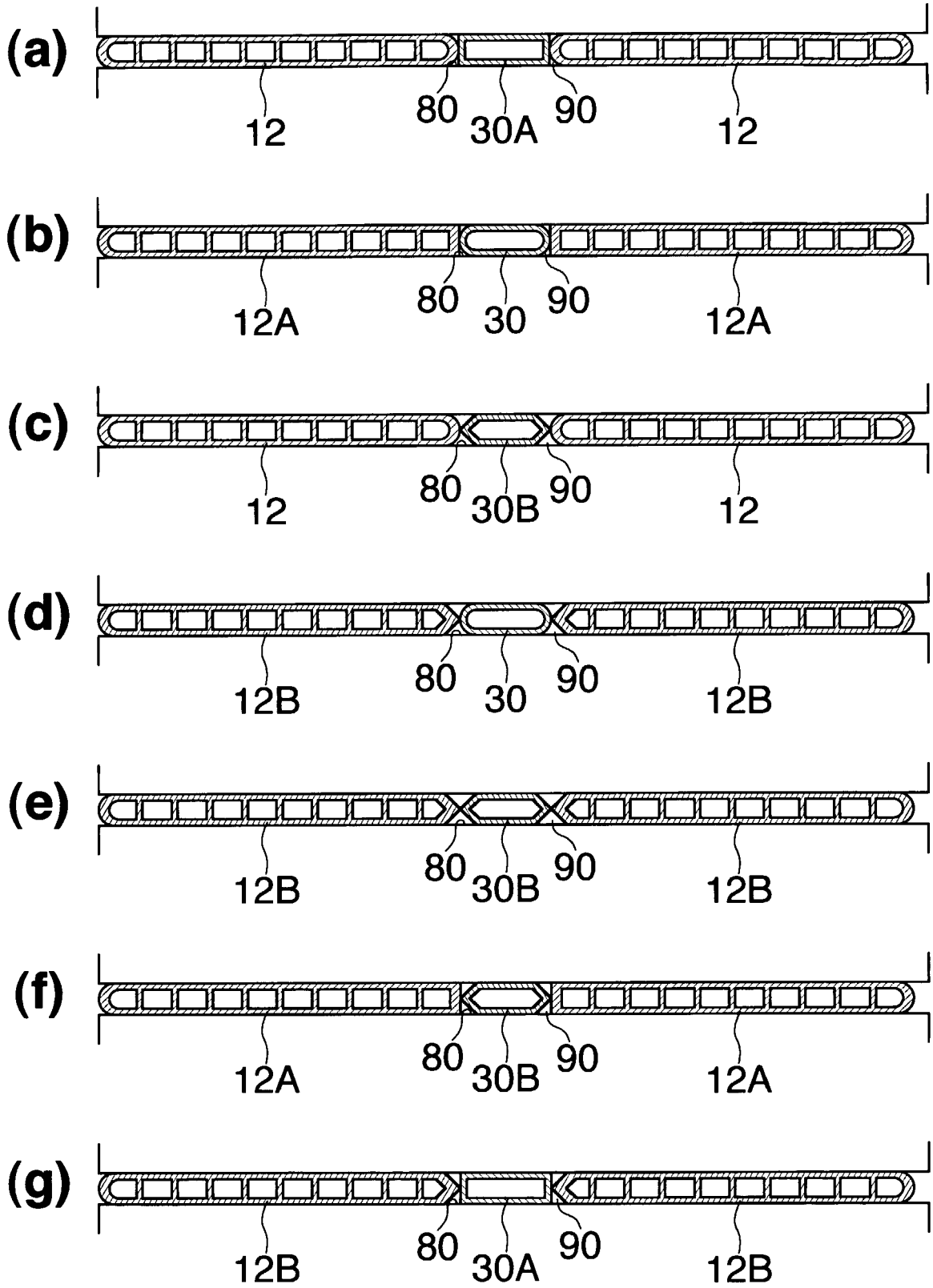
FIG. 14 is a set of horizontal sectional views showing other modified embodiments of a drainage acceleration member and those of a heat exchange tube.

FIG. 14 shows modified embodiments in which the heat exchange tube and the drainage acceleration member are in contact with each other such that, as in the case of Embodiment 2, the recesses (90) are formed between the front heat exchange tube (12) and the drainage acceleration member (30) and between the rear heat exchange tube (12) and the drainage acceleration member (30) in such a manner as to be depressed inward with respect to the left-right direction from extension surfaces of the left and right side surfaces of the heat exchange tubes (12) and to extend vertically, whereby the recesses (90) serve as drain channels (80). In the description of the modified embodiments, corresponding parts of Embodiment 2 and the modified embodiments are denoted by like reference numerals, and repeated description thereof is omitted.

In the modified embodiment shown in FIG. 14(*a*), the horizontal cross-sectional shape of the drainage acceleration member (30A) is the same as that shown in FIG. 13(*a*).

In the modified embodiment shown in FIG. 14(*b*), the horizontal cross-sectional shape of the front and rear heat exchange tubes (12A) is the same as that shown in FIG. 13(*b*).

In the modified embodiment shown in FIG. 14(*c*), the horizontal cross-sectional shape of the drainage acceleration member (30B) is the same as that shown in FIG. 13(*c*).

In the modified embodiment shown in FIG. 14(*d*), the horizontal cross-sectional shape of the front and rear heat exchange tubes (12B) is the same as that shown in FIG. 13(*d*).

In the modified embodiment shown in FIG. 14(*e*), the horizontal cross-sectional shape of the drainage acceleration member (30B) and that of the front and rear heat exchange tubes (12B) are the same as those shown in FIG. 13(*e*).

In the modified embodiment shown in FIG. 14(*f*), the horizontal cross-sectional shape of the drainage acceleration member (30B) and that of the front and rear heat exchange tubes (12A) are the same as those shown in FIG. 13(*g*).

In the modified embodiment shown in FIG. 14(*g*), the horizontal cross-sectional shape of the drainage acceleration member (30A) and that of the front and rear heat exchange tubes (12B) are the same as those shown in FIG. 13(*h*).

In the modified embodiments shown in FIG. 14, the drainage acceleration members (30), (30A), and (30B) are made of aluminum and are hollow. The thickness along the left-right direction of the heat exchange tubes (12), (12A), and (12B) and that of the drainage acceleration members (30), (30A), and (30B) are equal to each other. Preferably, the requirement mentioned in the section of Embodiment 2; i.e., $0.05\leqq S/h\leqq 1.5$, is satisfied, where S ($mm^2$) is the cross-sectional area of the drain channel, and h (mm) is the thickness of the heat exchange tubes (12) and the thickness of the drainage acceleration members (30) as measured in the left-right direction.

Embodiments 1 and 2, and the modified embodiments shown in FIGS. 13 and 14 are described while mentioning the hollow drainage acceleration members. However, the present invention is not limited thereto. The drainage acceleration members may be solid.

In the case where a drainage acceleration member is solid, a drain groove extending vertically may be formed on at least either left or right side surface of the drainage acceleration member. Specific examples of such a drainage groove will next be described with reference to FIG. 15.

Figure 15:
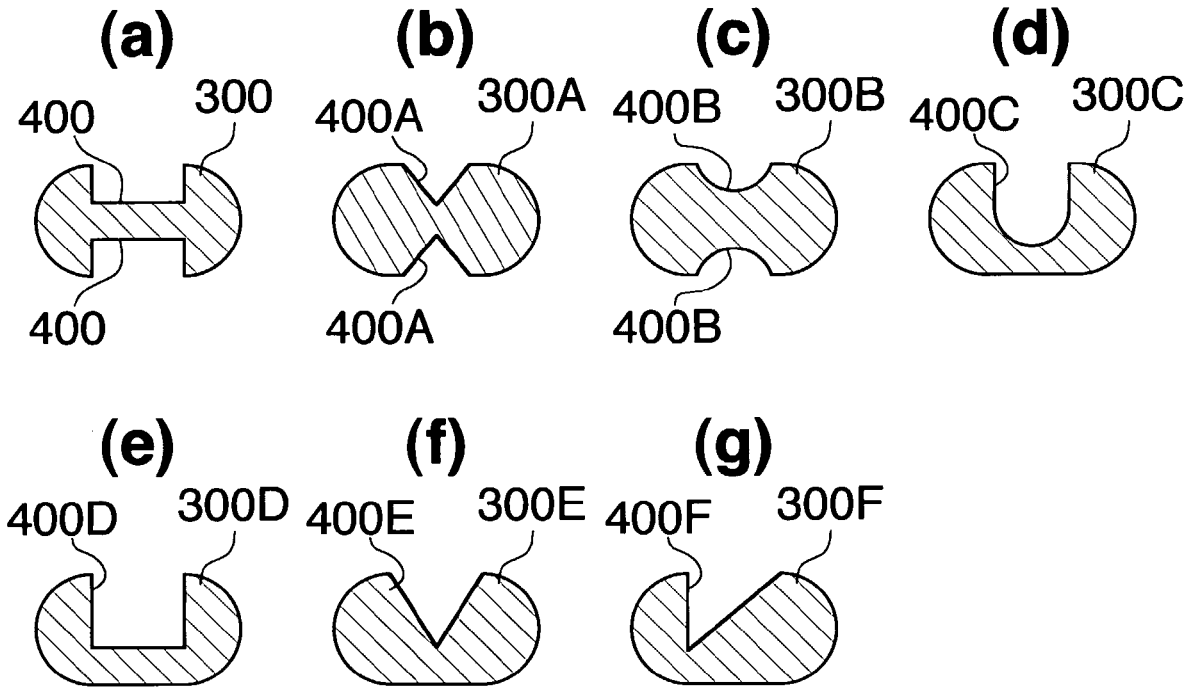
FIG. 15 is a set of horizontal sectional views showing further modified embodiments of a drainage acceleration member.

In a drainage acceleration member (300) of FIG. 15(*a*), a drain groove (400) having a rectangular cross section is formed on each of the left and right side surfaces.

In a drainage acceleration member (300A) of FIG. 15(*b*), a drain groove (400A) having a V-shaped cross section is formed on each of the left and right side surfaces.

In a drainage acceleration member (300B) of FIG. 15(*c*), a drain groove (400B) having an arcuate cross section is formed on each of the left and right side surfaces.

In a drainage acceleration member (300C) of FIG. 15(*d*), a drain groove (400C) having a U-shaped cross section is formed on one side surface.

In a drainage acceleration member (300D) of FIG. 15(*e*), a drain groove (400D) having a rectangular cross section is formed on one side surface.

In a drainage acceleration member (300E) of FIG. 15(*f*), a drain groove (400E) having a V-shaped cross section is formed on one side surface.

In a drainage acceleration member (300F) of FIG. 15(*g*), a drain groove (400F) having an irregularly-V-shaped cross section whose one side wall is perpendicular to the left and right side surfaces thereof is formed on one side surface.

In FIGS. 15(*a*) to 15(*g*), each of the front and rear end surfaces of the drainage acceleration member has an arcuate horizontal cross section such that a central portion with respect to the left-right direction projects outward with respect to the front-rear direction. However, the present invention is not limited thereto. The horizontal cross section may be shaped as shown in FIGS. 13(*a*) and 13(*c*).

INDUSTRIAL APPLICABILITY

The evaporator of the present invention is built and used in a car air conditioner, which a refrigeration cycle mounted on, for example, an automobile.

The invention claimed is:

1. An evaporator comprising:

a plurality of heat exchange tubes extending vertically and arranged in rows spaced apart from each other in a front-rear direction, wherein a drainage acceleration member extending vertically is disposed between the adjacent front and rear heat exchange tubes, a drain channel is formed between the front heat exchange tube and the drainage acceleration member and between the rear heat exchange tube and the drainage acceleration member, the heat exchange tubes are flat and are arranged such that a width direction thereof coincides with the front-rear direction, the thickness of the drainage acceleration member as measured in the left-right direction is equal to the thickness of the heat exchange tube as measured in the left-right direction, outer surfaces of end walls of the front and rear heat exchange tubes in opposition to the drainage acceleration member have one of an arcuate horizontal cross section and a V-shaped horizontal cross section, and front and rear end surfaces of the drainage acceleration member have one of an arcuate horizontal cross section and a V-shaped horizontal cross section.

2. The evaporator according to claim 1, wherein outer surfaces of end walls of the front and rear heat exchange tubes in opposition to the drainage acceleration member, and front and rear end surfaces of the drainage acceleration member have an arcuate horizontal cross section.

3. The evaporator according to claim 1, wherein outer surfaces of end walls of the front and rear heat exchange tubes in opposition to the drainage acceleration member have an arcuate horizontal cross section, whereas front and rear end surfaces of the drainage acceleration member have a V-shaped horizontal cross section; alternatively, the outer surfaces of end walls of the front and rear heat exchange tubes in opposition to the drainage acceleration member have a V-shaped horizontal cross section, whereas the front and rear end surfaces of the drainage acceleration member have an arcuate horizontal cross section.

4. The evaporator according to claim 1, wherein outer surfaces of end walls of the front and rear heat exchange tubes in opposition to the drainage acceleration member, and front and rear end surfaces of the drainage acceleration member have a V-shaped horizontal cross section.

5. The evaporator according to claim 1, wherein a drain groove extending vertically is formed on at least one of left and right side surface of the drainage acceleration member.

6. A refrigeration cycle comprising a compressor, a condenser, and the evaporator according to claim 1, wherein the refrigeration cycle uses a chlorofluorocarbon-based refrigerant.

7. The evaporator according to claim 1, wherein a gap is present between at least one of the two adjacent front and rear heat exchange tubes, and the drainage acceleration member disposed between the two heat exchange tubes, and the gap serves as the drain channel.

8. An evaporator comprising:

a plurality of heat exchange tubes extending vertically and arranged in rows spaced apart from each other in a front-rear direction, wherein a drainage acceleration member extending vertically is disposed between the adjacent front and rear heat exchange tubes, a drain channel is formed between the front heat exchange tube and the drainage acceleration member and between the rear heat exchange tube and the drainage acceleration member, the heat exchange tubes are flat and are arranged such that a width direction thereof coincides with the front-rear direction, the thickness of the drainage acceleration member as measured in the left-fight direction is equal to the thickness of the heat exchange tube as measured in the left-fight direction, a gap is present between at least one of the two adjacent front and rear heat exchange tubes, and the drainage acceleration member disposed between the two heat exchange tubes; the gap serves as the drain channel; and a relation $0<w/h\leqq 1/4$ is satisfied, where h (mm) is the thickness of the heat exchange tube and the thickness of the drainage acceleration member as measured in the left-fight direction, and w (mm) is the width of the drain channel as measured in the front-rear direction.

9. The evaporator according to claim 8, wherein an outer surface of an end wall of the heat exchange tube in opposition to the drain channel, and an outer surface of the drainage acceleration member in opposition to the drain channel are flat surfaces perpendicular to left and right side surfaces of the heat exchange tube.

10. A refrigeration cycle comprising a compressor, a condenser, and the evaporator according to claim 8, wherein the refrigeration cycle uses a chlorofluorocarbon-based refrigerant.

11. The evaporator according to claim 8, wherein a drain groove extending vertically is formed on at least one of left and right side surface of the drainage acceleration member.

12. An evaporator comprising:

a plurality of heat exchange tubes extending vertically and arranged in rows spaced apart from each other in a front-rear direction, wherein a drainage acceleration member extending vertically is disposed between the adjacent front and rear heat exchange tubes, a drain channel is formed between the front heat exchange tube and the drainage acceleration member and between the rear heat exchange tube and the drainage acceleration member, the heat exchange tubes are flat and are arranged such that a width direction thereof coincides with the front-rear direction, the thickness of the drainage acceleration member as measured in the left-fight direction is equal to the thickness of the heat exchange tube as measured in the left-fight direction, at least one of the two adjacent front and rear heat exchange tubes, and the drainage acceleration member disposed between the two heat exchange tubes are in contact with each other, a recess is formed between the drainage acceleration member and the heat exchange tube in contact with the drainage acceleration member in such a manner as to be depressed inward with respect to the left-fight direction from an extension surface of a left side surface of the heat exchange tube and to extend vertically, a recess is formed between the drainage acceleration member and the heat exchange tube in contact with the drainage acceleration member in such a manner as to be depressed inward with respect to the left-right direction from an extension surface of a right side surface of the heat exchange tube and to extend vertically, he recesses serve as the drain channels, and a relation $0.05\leqq S/h\leqq 1.5$, is satisfied, where S ($mm^2$) is the cross-sectional area of the drain channel, and h (mm) is the thickness of the heat exchange tube and the thickness of the drainage acceleration member as measured in the left-right direction.

13. A refrigeration cycle comprising a compressor, a condenser, and the evaporator according to claim 12, wherein the refrigeration cycle uses a chlorofluorocarbon-based refrigerant.

14. The evaporator according to claim 12, wherein a drain groove extending vertically is formed on at least one of left and right side surface of the drainage acceleration member.

15. An evaporator comprising:

a plurality of heat exchange tubes extending vertically and arranged in rows spaced apart from each other in a front-rear direction, wherein a drainage acceleration member extending vertically is disposed between the adjacent front and rear heat exchange tubes, a drain channel is formed between the front heat exchange tube and the drainage acceleration member and between the rear heat exchange tube and the drainage acceleration member, the heat exchange tubes are flat and are arranged such that a width direction thereof coincides with the front-rear direction, the thickness of the drainage acceleration member as measured in the left-right direction is equal to the thickness of the heat exchange tube as measured in the left-right direction, outer surfaces of end walls of the front and rear heat exchange tubes in opposition to the drainage acceleration member have an arcuate horizontal cross section, whereas front and rear end surfaces of the drainage acceleration member are flat surfaces perpendicular to left and right side surfaces of the heat exchange tubes;

alternatively, the outer surfaces of end walls of the front and rear heat exchange tubes in opposition to the drainage acceleration member are flat surfaces perpendicular to the left and right side surfaces of the heat exchange tubes, whereas the front and rear end surfaces of the drainage acceleration member have an arcuate horizontal cross section.

16. A refrigeration cycle comprising a compressor, a condenser, and the evaporator according to claim 15, wherein the refrigeration cycle uses a chlorofluorocarbon-based refrigerant.

17. The evaporator according to claim 15, wherein a drain groove extending vertically is formed on at least one of left and right side surface of the drainage acceleration member.

18. The evaporator according to claim 15, wherein a gap is present between at least one of the two adjacent front and rear heat exchange tubes, and the drainage acceleration member disposed between the two heat exchange tubes, and the gap serves as the drain channel.

19. An evaporator comprising:

a plurality of heat exchange tubes extending vertically and arranged in rows spaced apart from each other in a front-rear direction, wherein a drainage acceleration member extending vertically is disposed between the adjacent front and rear heat exchange tubes, a drain channel is formed between the front heat exchange tube and the drainage acceleration member and between the rear heat exchange tube and the drainage acceleration member, the heat exchange tubes are flat and are arranged such that a width direction thereof coincides with the front-rear direction, the thickness of the drainage acceleration member as measured in the left-right direction is equal to the thickness of the heat exchange tube as measured in the left-right direction, outer surfaces of end walls of the front and rear heat exchange tubes in opposition to the drainage acceleration member have a V-shaped horizontal cross section, whereas front and rear end surfaces of the drainage acceleration member are flat surfaces perpendicular to left and fight side surfaces of the heat exchange tubes; alternatively, the outer surfaces of end walls of the front and rear heat exchange tubes in opposition to the drainage acceleration member are flat surfaces perpendicular to the left and right side surfaces of the heat exchange tubes, whereas the front and rear end surfaces of the drainage acceleration member have a V-shaped horizontal cross section.

20. A refrigeration cycle comprising a compressor, a condenser, and the evaporator according to claim 19, wherein the refrigeration cycle uses a chlorofluorocarbon-based refrigerant.

21. The evaporator according to claim 19, wherein a drain groove extending vertically is formed on at least one of left and right side surface of the drainage acceleration member.

22. The evaporator according to claim 19, wherein a gap is present between at least one of the two adjacent front and rear heat exchange tubes, and the drainage acceleration member disposed between the two heat exchange tubes, and the gap serves as the drain channel.

* * * * *